US005866834A

United States Patent [19]

Burke et al.

[11] Patent Number: 5,866,834

[45] Date of Patent: Feb. 2, 1999

[54] DIGITALLY CONTROLLED ANALOG ELECTRIC STRINGED MUSICAL INSTRUMENT AND APPARATUS

[75] Inventors: Jim Burke, Hermitage, Tenn.; William K. Flint, Oakland, Calif.

[73] Assignee: Gibson Guitar Corp., Nashville, Tenn.

[21] Appl. No.: 771,112

[22] Filed: Dec. 20, 1996

[51] Int. Cl.[6] ..... G10H 1/06; G10H 1/46; G10H 3/18

[52] U.S. Cl. ..... 84/622; 84/633; 84/735; 84/741

[58] Field of Search ..... 84/723–742, 622–625, 84/659–661, 665, 477 R, 478, 633

[56] References Cited

U.S. PATENT DOCUMENTS

| | | | |
|---|---|---|---|
| Re. 26,533 | 3/1969 | Cookerly et al. | 84/738 X |
| 3,709,084 | 1/1973 | Stobaugh | 84/726 |
| 4,175,462 | 11/1979 | Simon | 84/728 |
| 4,327,419 | 4/1982 | Deutsch et al. | 364/717 |
| 4,336,734 | 6/1982 | Polson | 84/1.01 |
| 4,823,667 | 4/1989 | Deutsch et al. | 84/1.16 |
| 4,913,024 | 4/1990 | Carriveau | 84/726 |
| 5,001,960 | 3/1991 | Katou | 84/735 |
| 5,007,324 | 4/1991 | DeMichele | 84/741 |
| 5,014,589 | 5/1991 | Obata | 84/735 |
| 5,085,120 | 2/1992 | Ishiguro | 84/737 |
| 5,140,890 | 8/1992 | Elion | 84/736 |
| 5,585,583 | 12/1996 | Owen | 84/477 R |

*Primary Examiner*—Stanley J. Witkowski
*Attorney, Agent, or Firm*—McAfee & Taft

[57] ABSTRACT

An electric stringed musical instrument that produces and processes electric signals through an analog circuit has the analog circuit digitally controlled. The digital control is preferably such that it enables desired preset conditions for the analog circuit to be stored and later recalled in a simple, rapid manner by a musician while he or she is playing the instrument. The instrument can additionally, or alternatively, include energy management and string responsiveness features.

32 Claims, 7 Drawing Sheets

DIGITALLY CONTROLLED ANALOG ELECTRIC STRINGED MUSICAL INSTRUMENT AND APPARATUS

BACKGROUND OF THE INVENTION

The present invention relates to electric stringed musical instruments which generate analog electric signals in response to playing one or more strings of the instrument and which modify the electric signals through an analog circuit mounted on the instrument. It is a particular aspect of the present invention that the analog signal is digitally controlled, preferably such that desired preset conditions for the analog circuit can be stored and later recalled in a simple, rapid manner by a musician while he or she is playing the instrument. Another aspect is to conserve electrical energy when the instrument is operational. Still another aspect is to provide a control signal, such as for use in the energy conservation, in response to movement of at least one of the strings of the instrument.

Although the present invention is applicable to and encompasses any electric stringed musical instrument of a type suitable for the digital control referred to in this specification, it will be described with reference specifically to electric guitars. The term "electric guitar" as used in this specification and in the claims encompasses electric bass guitars, electric lead or rhythm guitars, and any other similar instrument despite any differences such as the number and type of pickup, the nature of the analog circuit through which signals from the pickup(s) are processed, and the type and layout of the controls located on the guitar body and manipulated by the musician.

A conventional electric guitar has a body to which the strings are attached and on which various controls are located. One or more pickups are mounted on the body beneath the strings so that electric signals are generated in response to movement of the strings. One type of pickup is electromagnetic whereby the electric signals are produced in response to string movement through the magnetic field. An analog circuit typically containing one or more resistors and capacitors connects between the pickup(s) and an output jack in which a cord is plugged to connect the analog circuit of the guitar to a preamplifier or amplifier. One or more of these resistors and capacitors has a variable resistance or capacitance which the musician can change by manipulating the controls which are mounted to the guitar body and connected to the variable analog circuit components. This control allows the musician to change the tone (frequency blend) and volume (magnitude) of the electric signals provided to the output jack.

With this conventional analog electric guitar, the guitarist has to manually change the respective control knobs or switches on the guitar body to obtain a desired tone and volume. This can be inconvenient and inexact when the musician has to do this during the course of a live performance each time he or she gets to a musical passage or song that requires the analog circuit parameters to be changed. That is, for a particular passage or song, the musician may know ahead of time that a desired set is to be used; and with a conventional electric guitar, the musician also knows that the desired set will have to be manually input by turning one or more respective knobs or moving one or more switch arms. It would be desirable if such desired settings could be implemented without the musician having to directly make each setting adjustment for all the analog circuit parameters that need to be changed for the desired set, and yet still have the electric guitar otherwise be operated, and sound, the same as the conventional electric guitar. More broadly, there is the need for a digitally controlled analog electric stringed musical instrument that can be operated in a conventional manner and that provides the instrument's conventional sound.

SUMMARY OF THE INVENTION

The present invention satisfies the above-noted and other needs by providing a novel and improved digitally controlled analog electric stringed musical instrument and apparatus. The present invention maintains the look, feel and sound of the conventional instrument. It allows for conventional control of the instrument by the musician, but it also enables the musician to store and recall desired settings or presets to which the analog circuit of the instrument is to be configured at the command of the musician. The invention also allows for conventional control by the musician from any preset condition.

The present invention provides an electric stringed musical instrument apparatus which comprises a manually operable tone-control member and a manually operable volume-control member (as used in this specification and in the claims, "tone" encompasses all facets pertaining to the frequency composition or nature of the signal/sound, whether by different pickup combinations or resistor/capacitor adjustments or otherwise, whereas "volume" encompasses all facets pertaining to the magnitude or amplitude of the signal/sound). This apparatus of the present invention also comprises an analog circuit for an analog electric signal generated by an electric stringed musical instrument. It further comprises a digital control circuit connected to the tone-control member, the volume-control member, and the analog circuit such that the digital control circuit digitally controls the analog circuit in response to the tone-control member and the volume-control member. Preferably, the digital control circuit includes a memory in which to store a preset combination of tone and volume control information. In this embodiment the apparatus further comprises a manually operable switch connected to the digital control circuit such that actuation of the switch causes the digital control circuit to control the analog circuit in response to the stored preset combination of tone and volume control information. The aforementioned apparatus can be manufactured integrally with the instrument or it can be a separate subassembly for use in converting an existing instrument.

As to the instrument itself, the present invention includes, in an electric stringed musical instrument including tone and volume control knobs and a pickup which generates an electric signal in response to movement of one or more strings of the instrument, the improvement comprising a digitally controlled analog circuit which modifies the electric signal from the pickup in response to settings of the tone and volume control knobs. This preferably further comprises a digital memory having storage locations for predetermined tone and volume control information, with the digital memory connected to the digitally controlled analog circuit such that the analog circuit is responsive to predetermined tone and volume control information stored in the storage locations of the digital memory.

The present invention also provides an overall electric stringed musical instrument comprising: a body; strings connected to the body; a pickup connected to the body such that the pickup generates an electric signal in response to movement of at least one of the strings; tone adjustment means connected to the body such that a player of the musical instrument can actuate the tone adjustment member; volume adjustment means connected to the body such that the player can actuate the volume adjustment member; an output jack connected to the body; an analog circuit connected to the pickup and the output jack; and digital control means, connected to the body, the tone adjustment means, the volume adjustment means and the analog circuit, for controlling settings of the analog circuit. The digital control means preferably includes means for storing preset information with which to control the analog circuit.

In particular implementations of the foregoing, energy conservation is also provided. One specific technique for achieving this includes generating a control signal in response to movement of one or more of the strings. It is to be noted, however, that these advantages or features are suitable for other applications; therefore, these can be defined as follows.

With regard to energy conservation in general, the present invention provides an electric stringed musical instrument comprising: a body; strings connected to the body; a pickup connected to the body such that the pickup generates an electric signal in response to movement of at least one of the strings; an output jack connected to the body; and an electrical circuit connected to the pickup and the output jack to provide an output signal to the output jack in response to the electric signal from the pickup, the electrical circuit including means for controlling electrical energization of at least part of the electrical circuit when the instrument is in an operational state.

With regard to responsiveness to string movement, the present invention provides an electric stringed musical instrument comprising: a body; strings connected to the body; a pickup connected to the body such that the pickup generates an electric signal in response to movement of at least one of the strings; an output jack connected to the body; and an electrical circuit connected to the pickup and the output jack to provide an output signal to the output jack in response to the electric signal from the pickup, the electrical circuit including means for generating a control signal in response to movement of at least one of the strings.

Therefore, from the foregoing, it is a general object of the present invention to provide a novel and improved electric stringed musical instrument and apparatus having one or more of the features referred to above or as otherwise described herein. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a block diagram of controls and digital and analog circuits of the preferred embodiment for the guitar illustrated in FIG. 5.

DETAILED DESCRIPTION OF PREFERRED EMBODIMENTS

Figure 1:
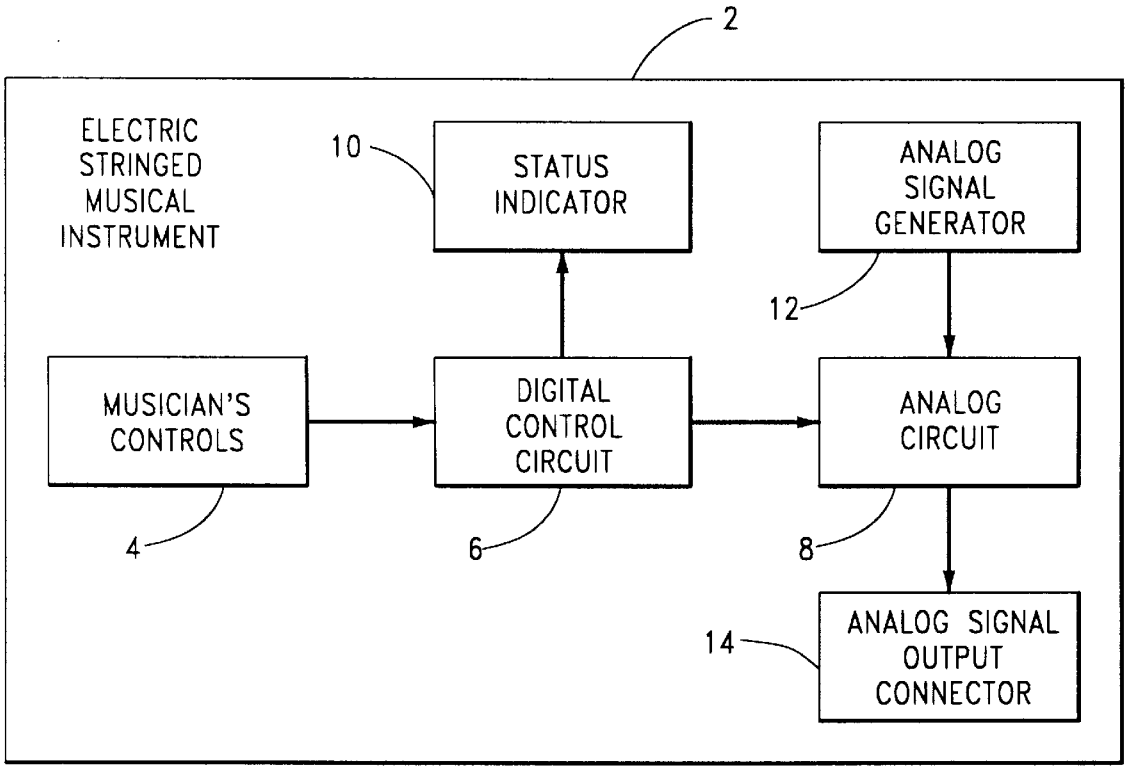
FIG. 1 is a block diagram of the present invention.

Referring to FIG. 1, an electric stringed musical instrument 2 is represented in block diagram form to include the apparatus of the present invention thereby providing the improved, inventive instrument of the present invention as well. The invention includes controls 4 which have the look and feel of conventional control elements that the instrument player or musician manipulates or actuates. These controls operate a digital control circuit 6 of the invention. The digital control circuit 6 controls an analog circuit 8 and it operates one or more status indicators 10. Although the analog circuit 8 is digitally controlled, it transfers and modifies an analog signal from an analog signal generator 12 to an analog signal output connector 14 while maintaining the analog signal in the analog domain. The foregoing results in an apparatus and instrument providing a conventional look, feel and sound but having enhanced control capabilities as will be further described below.

Although the present invention is applicable to any suitable type of electric stringed musical instrument, preferred embodiments of the invention depicted in FIG. 1 will be described in FIGS. 2–4 with reference to an electric bass guitar and in FIGS. 5 and 6 with reference to an electric lead or rhythm guitar.

Figure 2:
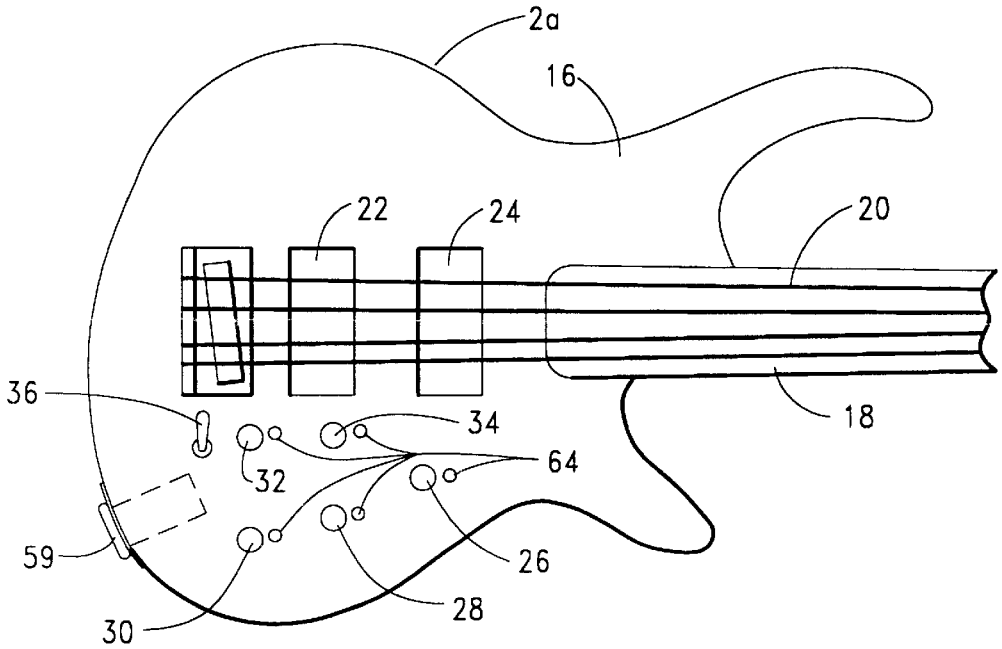
FIG. 2 is a partial representation of an electric bass guitar having control members in a conventional layout but adapted in accordance with the present invention.

Referring to FIG. 2, bass guitar 2*a* includes a body 16 from which a neck 18 extends and to which strings 20 are connected in conventional manner. Also connected to the body 16 in conventional manner are bridge pickup 22 and neck pickup 24 disposed beneath the strings 20 so that the pickups 22, 24 generate analog signals in response to movement of the strings 20 through magnetic fields of the pickups 22, 24 (if the pickups are of the electromagnetic type) as is well known. The pickups 22, 24 are included in the analog signal generator 12 of FIG. 1.

The musician's controls 4 of FIG. 1 are embodied in FIG. 2 by a treble cut/boost control 26, a midrange cut/boost control 28, a bass cut/boost control 30, a pickup pan control 32, a master volume control 34 and an equalization bypass switch arm 36. These are disposed on the body 16 and operated by the musician in a conventional manner with regard to the respective tone/volume/bypass functions referred to above with regard to each control member. That is, each of these controls (except the toggle switch arm 36, which is connected to a switch) is connected to a rotary member of a respective potentiometer. Additionally, in accordance with this preferred embodiment of the present invention, each of the controls 26–34 has a momentary contact single-pole single-throw push-push switch which the musician activates by depressing and releasing the respective control member 26–34. The control members 26–36 are laid out on the body 16 in a conventional manner so that they have the same look and feel to the musician except for the added feature of the depress/release function of the five knobs 26–34.

Figure 3:
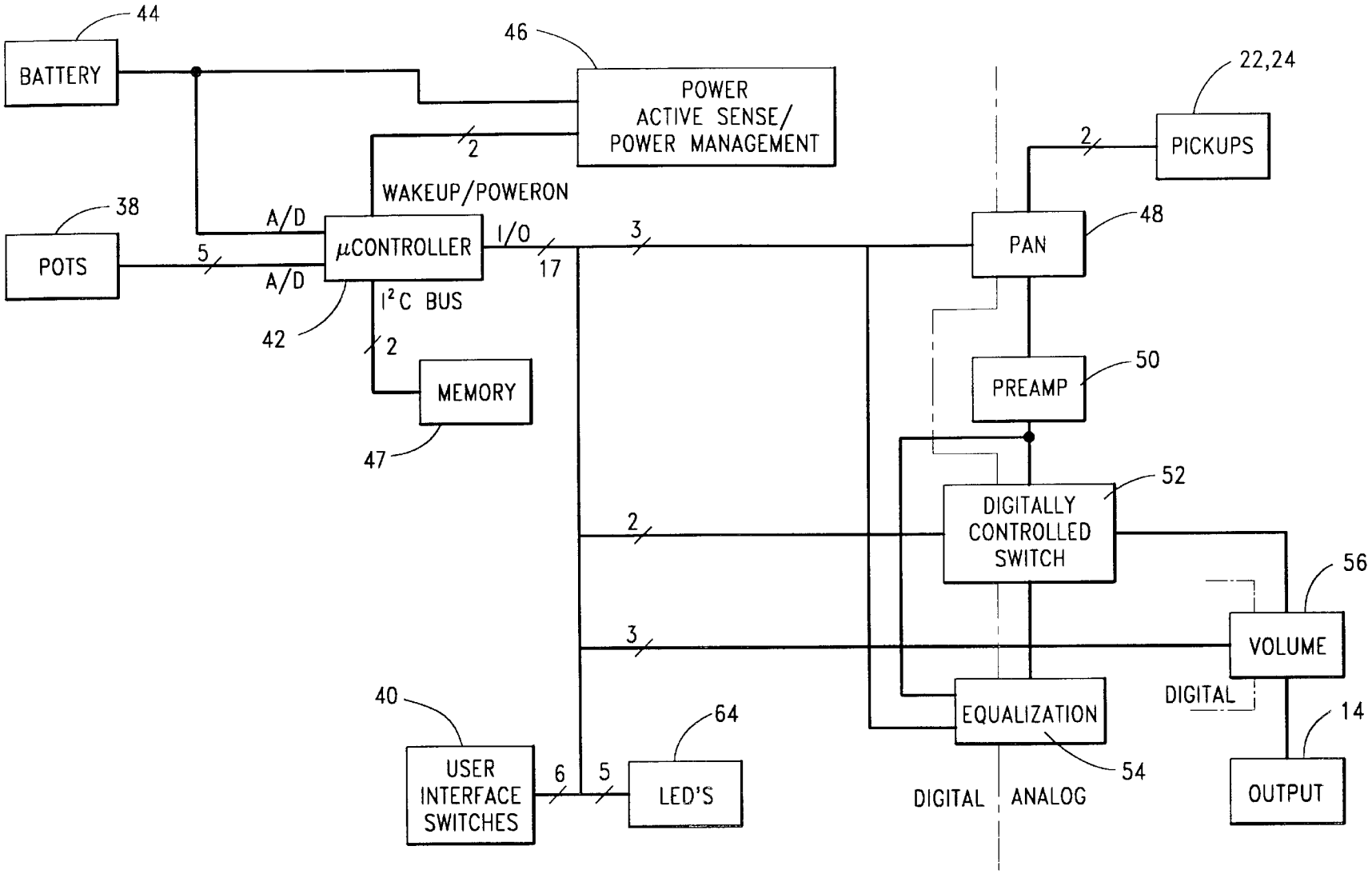
FIG. 3 is a block diagram of controls and digital and analog circuits of the preferred embodiment for the bass guitar illustrated in FIG. 2.

The aforementioned potentiometers and switches are represented in FIG. 3. These potentiometers (pots) are marked with the reference numeral 38, and the switches are marked with the reference numeral 40. Each of the five potentiometers 38 is connected to a respective one of the control knobs 26–34. Five of the switches 40 are the push-push switches combined with these potentiometers and the sixth switch is the switch to which the equalization bypass switch arm 36 connects.

Still referring to FIG. 3, the potentiometers 38 and the switches 40 provide electric inputs to a microcontroller 42 forming part of the preferred embodiment of the digital control circuit 6. The microcontroller 42 is energized from a battery 44 through a power active sense/power management circuit 46. The microcontroller 42 also monitors the battery level through an analog-to-digital (A/D) input as represented in FIG. 3. The outputs of the potentiometers 38 are also input through respective analog-to-digital inputs of the microcontroller 42.

The microcontroller 42 includes a microprocessor and program storage memory which holds the program under which the microcontroller operates in accordance with the present invention. Such a program can be readily implemented by one skilled in the arts given a particular microcontroller and the description of the invention given in this specification. An example of such a program is set forth at the end of this detailed description; however, it is to be noted that this is for a prototype and is not intended as a final product.

The digital circuit shown in FIG. 3 also includes a memory 47. This has storage locations where the microcontroller stores preset information for setting analog circuit parameters, which preset information is entered by the musician as further described below.

The microcontroller 42 provides digital outputs to control digitally controlled potentiometers of the analog circuit 8. The analog circuit 8 as embodied in FIG. 3 includes: a pan circuit 48 controlled by three outputs from the microcontroller 42; a preamplifier circuit 50 which receives the output from the pan circuit 48; and a digitally controlled switch 52 which receives the output from the preamplifier 50 and which also receives an output from an equalization circuit 54 of the analog circuit 8 that also receives the output of the preamplifier 50. The equalization circuit 54 is controlled by the three signal lines controlling the pan circuit 48. The digitally controlled switch 52 is controlled by two other digital outputs from the microcontroller 42. The output from the digitally controlled switch 52 is provided to a volume control circuit 56 of the analog circuit 8. The volume control circuit 56 is controlled by two of the three control signals controlling the pan and equalization circuits 48, 54 and another digital output signal from the microcontroller 42. The output from the volume adjustment circuit 56 is provided to the output connector 14 such as an output jack 59 of the bass guitar 2*a* (FIG. 2).

A particular implementation of the FIG. 3 embodiment is shown in FIGS. 4A–4F.

Figure 4A:
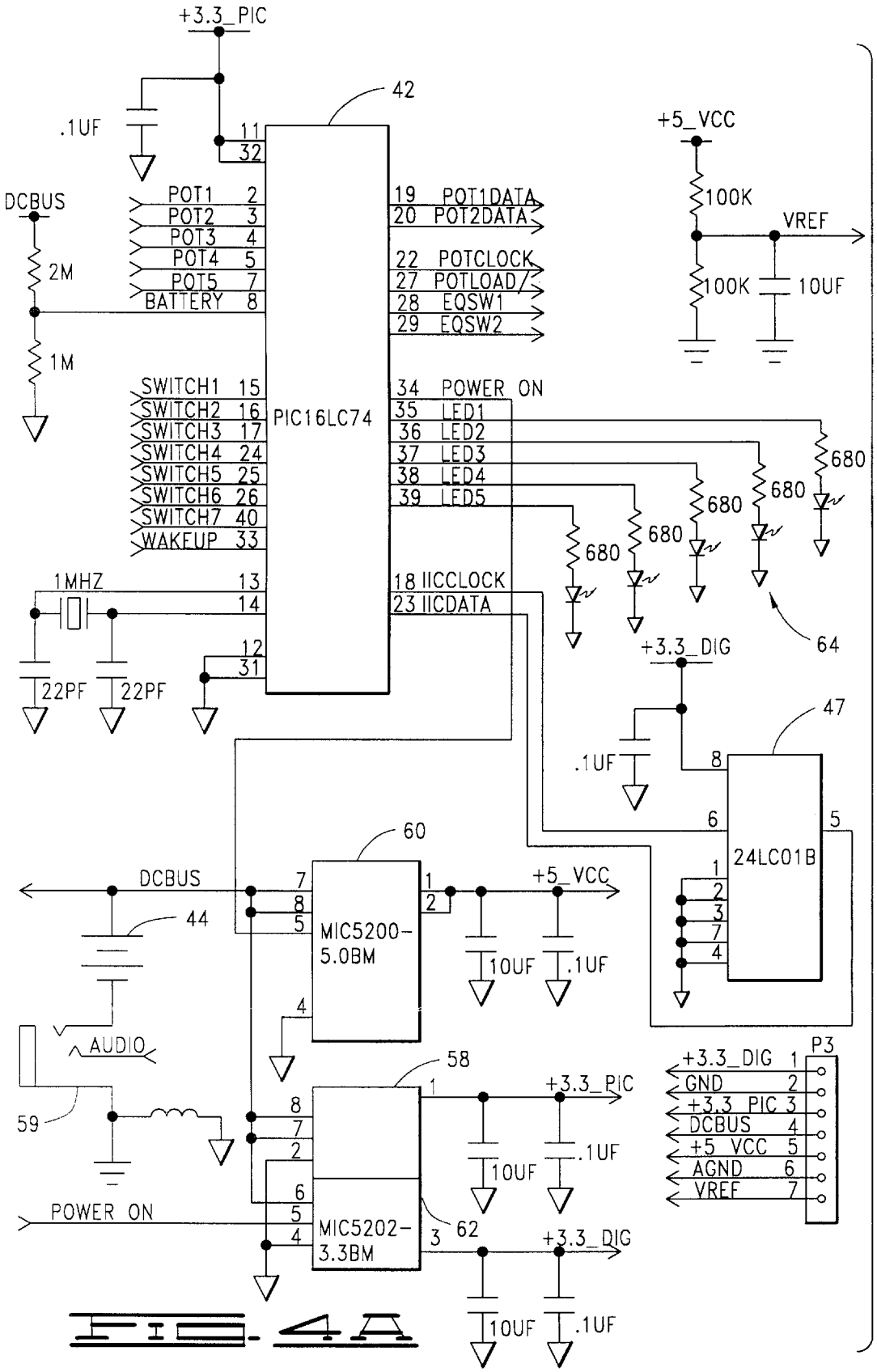
FIGS. 4A–4F are schematic circuit diagrams for a particular implementation of the controls and circuits shown in FIG. 3.

FIG. 4A shows a particular implementation of the microcontroller 42 and memory 47 (specifically implemented as an EEPROM).

Battery 44 is shown in FIG. 4A. It provides its energy to the system when a plug is inserted into output jack 59, thereby connecting the negative terminal of the battery 44 to electrical ground and placing the instrument in an operational state. When this happens, voltage conversion and regulator device 58 provides 3.3 volts to energize the microcontroller 42. The microcontroller 42 provides an output signal (POWERON) to enable voltage converter and regulator device 60 and voltage converter and regulator device 62 to provide the respective voltages shown in FIG. 4A. The power on signal is generated in response to an interrupt received by the microcontroller 42. This is provided by the wake-up signal generated through wake-up circuit 63, shown in FIG. 4B, in response to the bridge pickup 22 generating a signal (which occurs when a string is played). Thus, even though the instrument is in an operational state with a first circuit portion energized (microcontroller 42, device 58 and wake-up circuit 63), a second circuit portion (the remainder of the illustrated digital circuit) is in a powered down mode until the instrument is played (or a string is otherwise moved). The microcontroller 42 also has an internal program timer which times out if a wake-up signal is not received within a predetermined time. If this occurs once the microcontroller is generating the power on signal, the microcontroller 42 turns off the power on signal, thereby disabling the devices 60, 62. The invention operates in this lower power mode until another wake-up signal is generated. Thus, power is conserved if the musician does not play the instrument for a predetermined time. The circuits of elements 58, 60, 62 and FIG. 4B are included in the power active sense/power management circuit 46 of FIG. 3.

It is contemplated that the foregoing means pertaining to control of electrical energization and to responsiveness to string movement can be implemented in any suitable manner. For example, as to energization control, this can occur in response to manipulation of one or more control knobs or switches on the instrument in addition to or alternatively to occurring in response to movement of one or more strings. For example, such manipulation could generate an interrupt signal to the microcontroller 42, or the microcontroller 42 could periodically poll the devices for any changes indicating that power up is to occur.

Also with reference to FIG. 4A, the microcontroller 42 monitors the battery via input 8.

FIG. 4A also shows five light emitting diodes (LEDs) 64 embodying the status indicator 10 shown in FIG. 1. Each of the diodes 64 is co-located on the body 16 of the bass guitar 2*a* with a respective one of the control knobs 26–34 as shown in FIG. 2.

As mentioned, the control knobs 26–34 connect to respective potentiometers and push-push momentary contact switches. These potentiometers and switches are shown in FIG. 4C. Specifically, potentiometer 66 and switch 68 are connected to and operated by the control knob 26, potentiometer 70 and switch 72 are connected to and operated by control knob 28, potentiometer 74 and switch 76 are connected to and operated by control knob 30, potentiometer 78 and switch 80 are connected to and operated by control knob 32, and potentiometer 82 and switch 84 are connected to and operated by control knob 34. Switch arm 36 operates momentary mini-toggle switch 86 shown in FIG. 4C.

Referring to FIG. 4D, the pickups 22, 24 are connected to input preamplifier circuits 88, 90, respectively. The outputs of these circuits are input to a quad digital potentiometer device 92 shown in FIG. 4E. One of the digitally controlled potentiometers of the device 92 is controllable by the microcontroller 42 to provide a desired blend between the signals from the bridge and neck pickups. This defines the pan signal.

The pan signal output of the device 92 is connected to a further preamplifier circuit 94 shown in FIG. 4F. The output of preamplifier 94 is connected to the device 92 of FIG. 4E for equalization control via the bass, midrange and treble controls. Each of these has a respective one of the remaining three digitally controlled potentiometers of the device 92 respectively connected in the resistor-capacitor components shown in FIG. 4E which form a tone adjustment portion to define one or more resistance-capacitance characteristics that impart tone control to the signal from the instrumenmt's pickup(s). The bass adjustment circuit is identified in FIG. 4E by the reference numeral 96. The midrange adjustment circuit is identified in FIG. 4E by the reference numeral 98.

Figure 4:
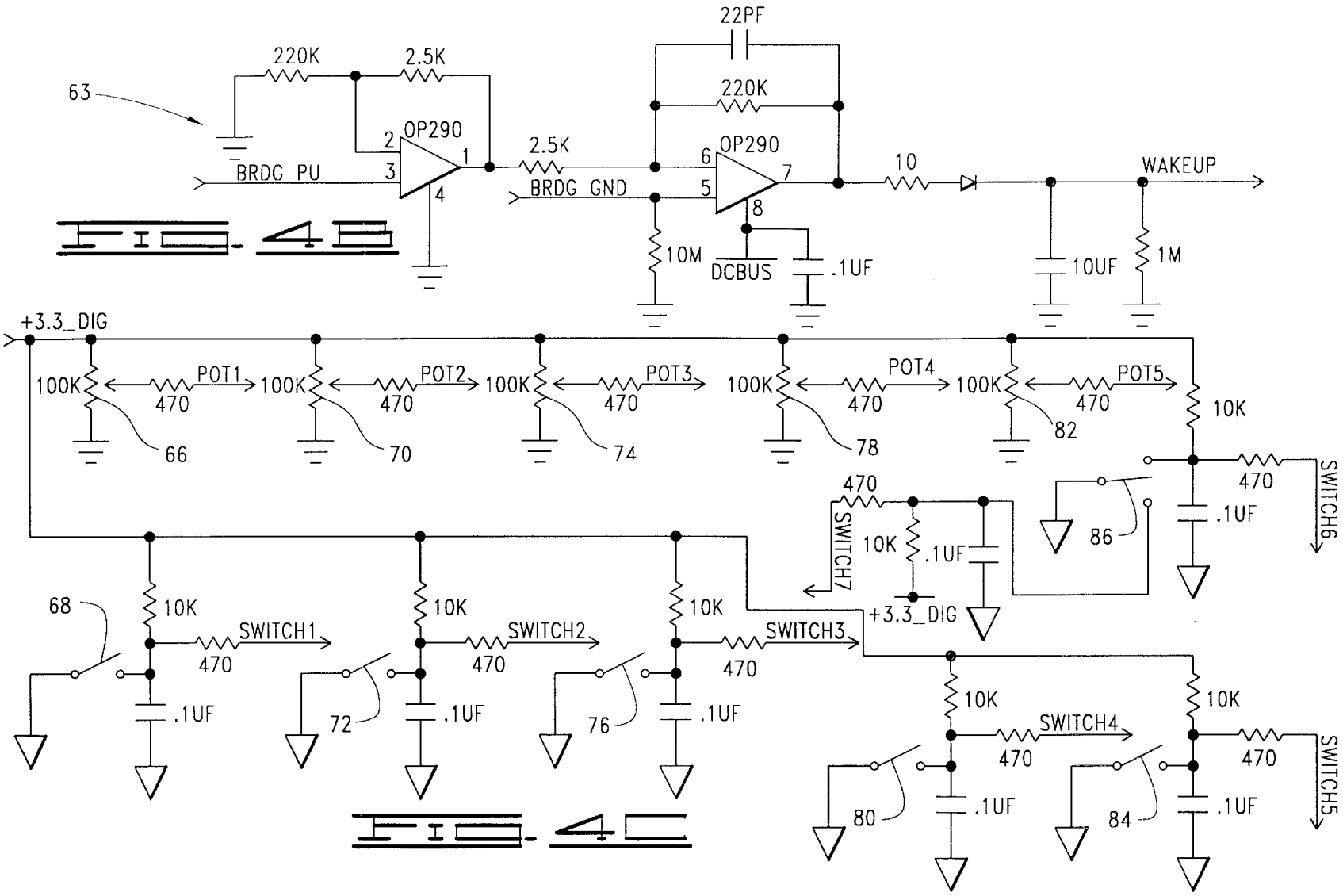
Figure 4:
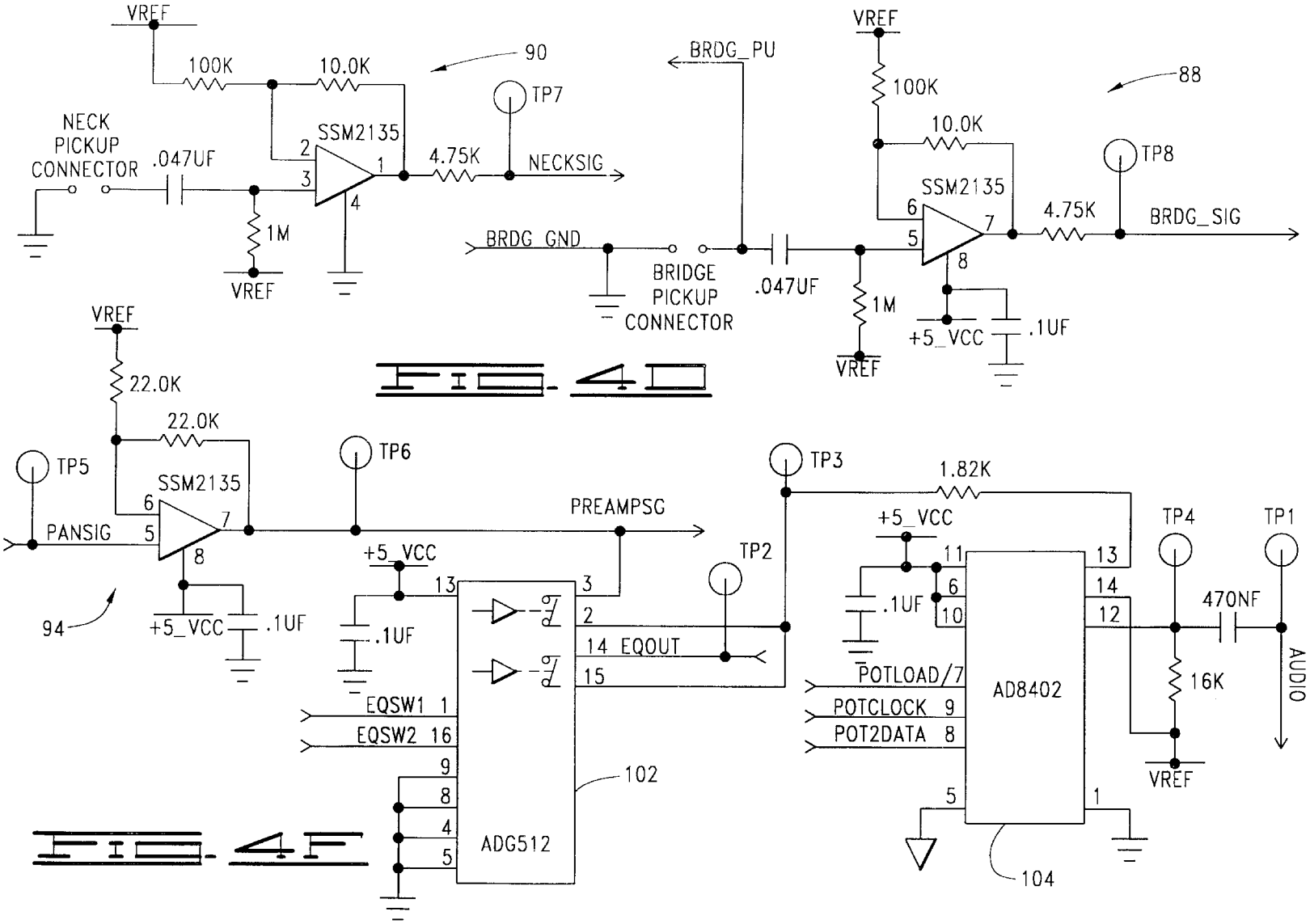
Figure 4E:
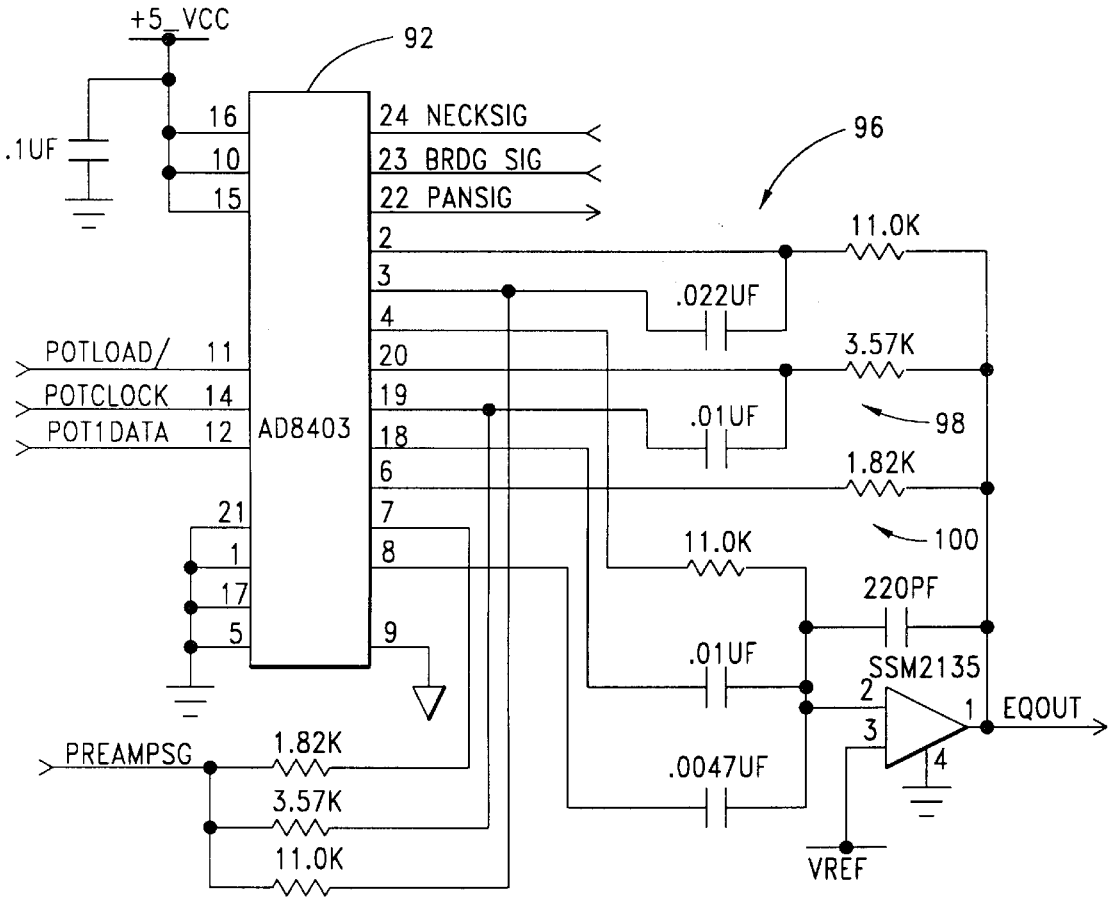

The treble adjustment circuit is identified in FIG. 4E by the reference numeral 100. The resulting equalized output (EQOUT) is returned to a digitally controlled switch device 102 shown in FIG. 4F. The microcontroller 42 provides two switch control signals (EQSW1, EQSW2) to select whether the preamplifier signal (PREAMPSIG) or the equalized output signal (EQOUT) is connected to digitally controlled potentiometer device 104 shown in FIG. 4F. The microcontroller 42 controls a digitally controlled potentiometer of the device 104 to set the resistance characteristic for volume adjustment for the signal (AUDIO) provided as the output audio signal which connects from the device 104 to the output jack 59 shown in FIG. 4A.

A specifically programmed implementation of the foregoing allows the player/musician to set up three presets, which will recall tone and/or volume settings previously entered into the memory 47 by the player. The player selects and activates one of the presets by pressing down on the tone knobs, which have the momentary switches built into them. For example, tapping on the treble knob 26 actuates switch 72 which signals the microcontroller 42 to recall preset 1 and send appropriate digital control signals denominated in FIG. 4A as follows: POT1DATA, POT2DATA, POTCLOCK, POTLOAD/, EQSW1, EQSW2. Tapping midrange control knob 28 recalls preset 2, and tapping the bass knob 30 switches to preset 3. This can be very fast since the player just taps the one he/she wants and parameters change immediately.

Once a preset has been selected, the control members 26–36 are still active and execute their normal functions, updating the respective parameter from the preset point in response to rotation of control knobs 26–34 or toggling of switch arm 36. The potentiometers to which the knobs 26–34 connect have limits to how far the wipers of the potentiometers can be rotated. This limits the sector through which the respective knobs 26–34 can be rotated. Since these limits might prevent the musician from reaching part of the full range of the respective parameter when the knob's physical position is different from the preset point, a "ratcheting" technique is used. When the knob reaches the end of its travel and the actual circuit parameter still has room to change further in that direction, the knob is turned back and then turned up again to effectively "ratchet" the value up; this is done quickly as the key to the programmed microcontroller 42 reading and applying this action as a continuing parameter change in the same direction. The advantage of this technique is an immediate response from the knobs, which feels more natural. A similar situation exists with the switch connected to the switch arm 36. A normal toggle switch could be set to a position that is different from the preset. With a momentary on/off/on switch, the switch always returns to the center and avoids the confusion; thus, this is the preferred implementation for the switch 86 operated by the switch arm 36. The player either pushes the switch arm 36 up or down to turn equalization on or off (if it is already on, turning it on again would not do anything). This same switch could be used among several different equalization circuits as well.

Storing new values in a storage location of the memory 47 is done by pressing the momentary switch 80 operated by the pan knob 32. This instantly stores the then-existing settings of the potentiometers 38 (i.e., pots 66–82) and the switch 86 into the current preset location selected by one of the knobs 26, 28, 30. This facilitates live playing, where a player might need to adjust a knob in a particular preset. Thus, storing tone and volume information for a preset occurs with minimal interruption in playing. The memory 47 is preferably non-volatile, so entered preset information is not erased when the power is off.

To let the player know that knob presses have been registered, the microcontroller 42 turns on the respective LED(s) 64 briefly (so that power consumption is reduced) next to the respective switch and knobs. When storing to the memory 47, the LEDs for both the store button (knob 32 for the above implementation) and the button for the preset being stored to (one of the knobs 26, 28, 30) come on briefly. When battery power gets low (as monitored via pin 8 of the microcontroller 42 of the FIG. 4A implementation), the LED next to the volume knob 34 flashes.

There are two ways to turn the circuit on and off in the implementation of FIG. 4. First, when a plug is in the jack 59, the instrument is on and in the preset mode; it can be turned off by pulling the plug out of the jack. Second, the momentary push switch of the volume knob 34 can be used to toggle the presets on and off; therefore, if the player wants to turn the presets off but still use the active equalization and preamp, the player merely taps the volume knob 34. Tapping it again brings the presets back on.

Although not shown in the drawings, there is preferably another switch mounted on the guitar to serve as an emergency switch in the event of a failure, such as loss of battery power. This switch would switch the analog circuitry to bypass the digital circuitry as needed at least to allow the analog signals from the pickups to be communicated to the output jack.

Another implementation of the invention depicted in FIG. 1 will be described with reference to FIGS. 5 and 6. This implementation pertains to a lead or rhythm guitar 2*b*. There are several variations for this guitar interface. One example is a guitar where each pickup connects to its own volume and tone circuit before going to the pickup selector; this is the example of FIGS. 5 and 6 as described below. Another is a guitar where the pickups go into the selector switch first and then to a single volume and tone knob. Other non-limiting variations include a presettable acoustic guitar preamp, an after-market product for people who want to upgrade their instrument, and an ultimate guitar that provides the maximum flexibility conceivable.

Figure 5:
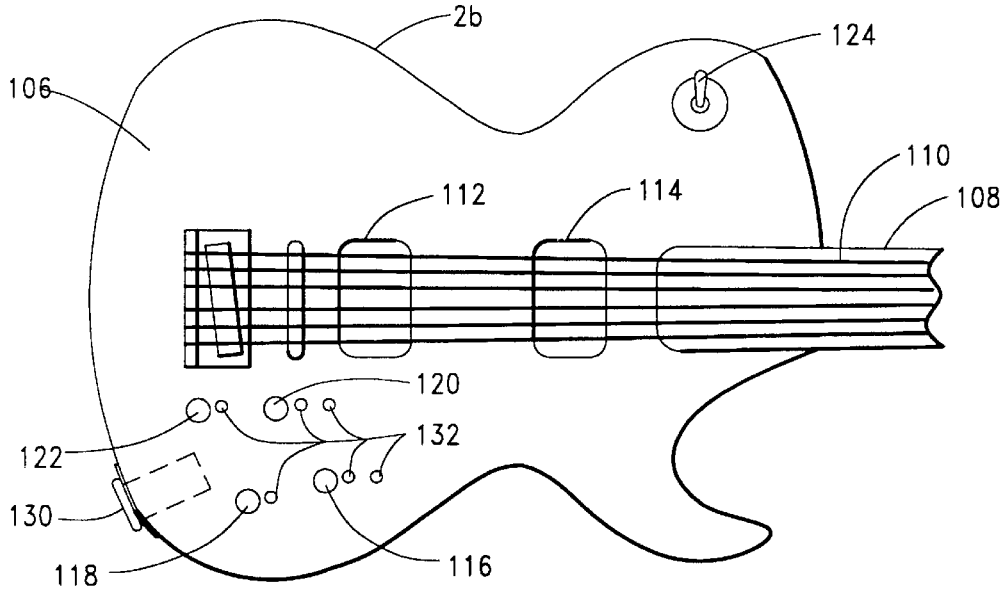
FIG. 5 is a partial representation of an electric lead or rhythm guitar having control members in a conventional layout but adapted in accordance with the present invention.
Figure 3:
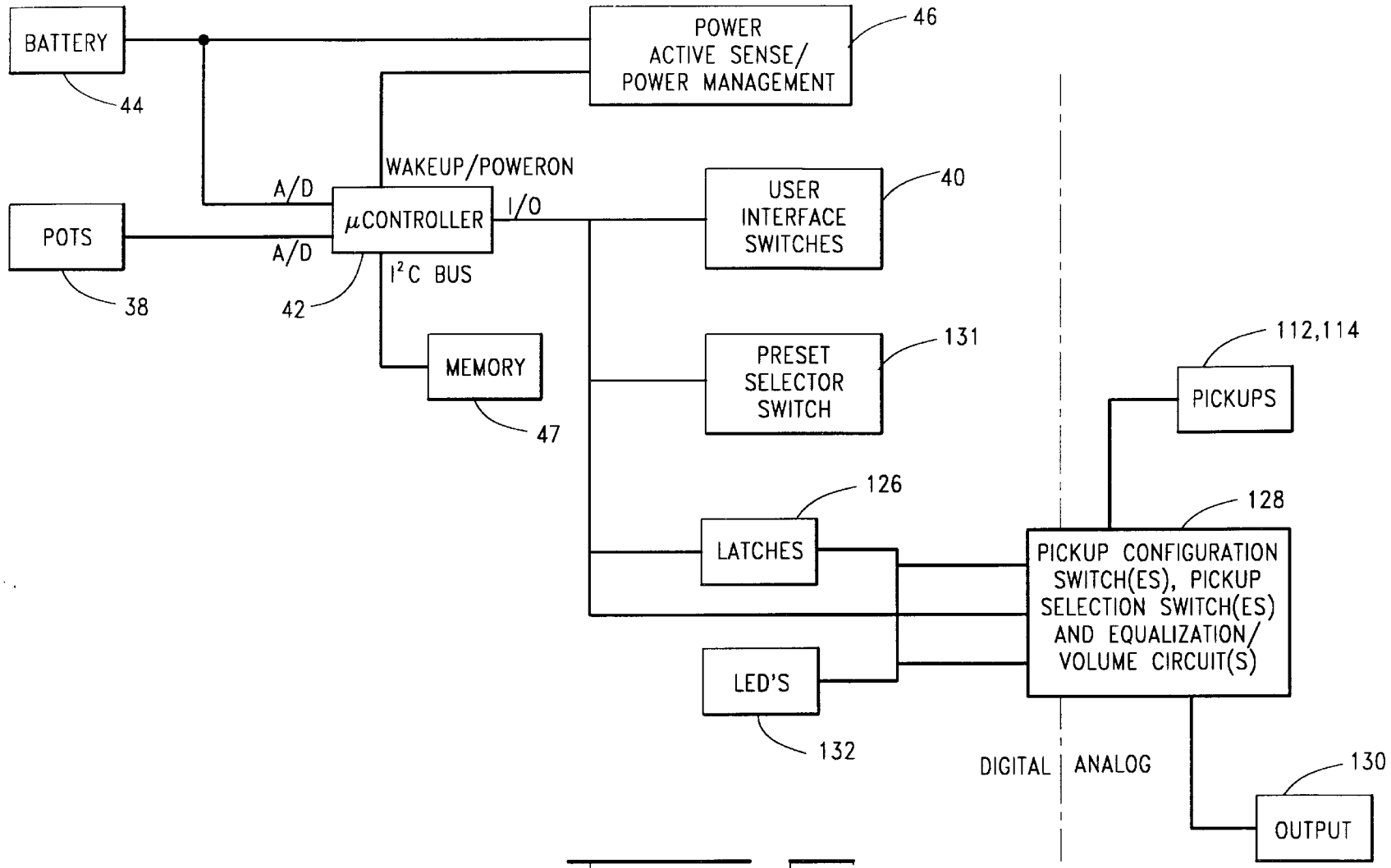

Referring to FIG. 5, the guitar 2*b* has a body 106 from which a neck 108 extends and to which strings 110 are connected. Dual-coil humbucking pickups 112, 114 are disposed and operate in conventional manner. Mounted and located in conventional manner are a bridge volume knob 116, a bridge tone knob 118, a neck volume knob 120 and a neck tone knob 122. A three-position selector switch actuator arm 124 is also mounted on the body 106.

The digital and analog circuits to which these controls connect are represented in FIG. 6. Components of FIG. 6 which can be implemented in the same manner as in the FIG. 3 embodiment are identified by the use of like reference numerals. The principal difference in the FIG. 6 implementation is that the digital output control signals from the microcontroller 42 are used to define pickup configuration, pickup selection and equalization/volume parameters of the type common to lead or rhythm guitars as opposed to the parameters in the bass guitar described above with reference to FIGS. 2–4. In the implementation of FIG. 6, this control is achieved through the output signals from the microcontroller 42 as well as from latches 126 operating digitally controlled potentiometers and digitally controlled switches 128 of the analog circuit connecting the pickups 112, 114 to output jack 130.

In the embodiment of FIGS. 5 and 6, a switch 131 operated by switch arm 124 is the preset selector switch which looks and functions just like a typical pickup selector switch, and it is located in the same spot. Rather than switching pickups, it switches among three presets (or other number of presets if a different switch is used) which the user can define. The knobs are also familiar, with the aforementioned volume and tone knobs for each pickup. Each knob connects to a momentary switch built into it just as in the embodiment of FIGS. 2–4. Each such switch is activated by pressing or tapping the knob down towards the guitar body. In a particular implementation of FIGS. 5 and 6, pressing the volume knobs 116, 120 sequences among three settings for the respective pickup—off, double coil, and single coil. The switch under the neck pickup's tone knob 122 is for phase; it toggles between in-phase and out-of-phase sounds when both pickups are on. The switch under the bridge pickup's tone knob 118 is the store function. As in the embodiment of FIGS. 2–4, these switches preferably are quick and intuitive to use, and preferably have the added advantage of eliminating the need for any extra switches and knobs.

Once the preset selector switch 131 has been switched to select a preset from the memory 47, the knobs 116–122 are still active and execute their normal functions, updating the parameter from the preset point. The previously described "ratcheting" technique can be used to overcome any difference between a preset parameter and the physical position of a knob.

Storing new values in memory 47 is done by pressing the momentary switch of the bridge pickup's tone knob 118. This instantly stores the current pickup configuration and potentiometer voltage settings into the preset location selected by the switch 124.

Small LEDs 132 located by each of the knobs are used to indicate the state of the guitar to the player. These LEDs will come on briefly when one of the knobs is pressed or a preset is changed. Two LEDs located next to each of the volume knobs indicate the pickup configuration, with each one representing one of the coils in a dual-coil humbucking pickup. If one is on, it is in single coil mode. If they are both on, it is double coil. If the LEDs do not come on, that pickup is off. The LEDs by the tone knobs come on briefly when those buttons are pressed. The knob with the phase switch has a two-color LED next to it, with green being in-phase and red being out-of-phase. When a new preset is selected, the appropriate LEDs will come on briefly to indicate what is in the preset. When the battery power is low, one of the LEDs will flash.

The foregoing implementations preferably use low power, microcontroller technology used in a manner to prolong battery life. It is preferred to use 3.3 volt and low power CMOS components, slow and dual clock speed techniques, and low power "sleep" modes to prolong battery life. Specific analog circuits will function from the analog standpoint the same as conventional analog circuits for the respective types of electric stringed musical instruments to which the present invention is applied. Mounting configurations to minimize size and shielding for low noise layout techniques are preferably used to minimize noise.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

```
;*****************************************************************************
; FILE: pre.a - preset bass controls
;*****************************************************************************
    list p=16c74,f=inhx8m
    include "reg.inc"
    include "pre.inc"

;*****************************************************************************
; Register Files - "Variables"
;*****************************************************************************
temp          equ 0x20        ;Temporary storage variable
isr_W         equ 0x35        ;for storing w while in ISR
isr_STATUS    equ 0x36        ;for storing status while in ISR
;
;
; i2c registers
;
i2c_bits      equ 0x21        ;Bit buffer
err_bits      equ 0x22        ;Common flag bits register
xmit_buf      equ 0x27        ;EEPROM xmit buffer
rcv_buf       equ 0x28        ;EEPROM recieve buffer
loop_cnt      equ 0x29        ;Bit counter
;
;
; eeprom registers
;
ee_addr       equ 0x23        ;Address register
ee_rd_data    equ 0x24        ;Stored data input register
ee_wr_data    equ 0x25        ;Stored data output register
temp1         equ 0x2B        ;More Temporary storage
;
;
; digital pots
;
Dpot_val      equ 0x38        ;current digital pot value
Dpot1_byte    equ 0x40        ;byte to send to digpot 1
Dpot2_byte    equ 0x41        ;byte to send to digpot 2
Dpot3_byte    equ 0x42        ;byte to send to digpot 3
Dpot_flag     equ 0x43        ;flag if new value avail. for dpots
;
;
; analog pots and A/D
;
; also need variables for last_pot, pot_stat of each pot,
new_pot       equ 0x2C        ;working variable for pot check routine
last_pot      equ 0x2D        ;working variable for pot check routine
cur_pot       equ 0x2E        ;not used anywhere
pot_stat      equ 0x37        ;determines current pot ratcheting status
new_pot_flag     equ 0x39        ;flag indicating new pot a/d read - ISR
new_pot0      equ 0x44        ;value of pot0 a/d reading - ISR
new_pot1      equ 0x45        ;value of pot1 a/d reading - ISR
new_pot2      equ 0x46        ;value of pot2 a/d reading - ISR
new_pot3      equ 0x47        ;value of pot3 a/d reading - ISR
new_pot4      equ 0x48        ;value of pot4 a/d reading - ISR
diff          equ 0x3A        ;difference between current and last read
;
;
; switches
;
cur_recall_sw    equ 0x2F        ;current state of recall switch
recall_sw_cnt    equ 0x30        ;recall switch debounce counter
recall_flag equ 0x31          ;flag if recall pressed
cur_store_sw     equ 0x32        ;current state of store switch
store_sw_cnt     equ 0x33        ;store switch debounce counter
store_flag   equ 0x34         ;flag if store switch pressed
cur_eq_sw    equ 0x50         ;current state of eq switch
```

```
eq_sw_cnt    equ 0x51        ;eq switch debounce counter
eq_flag      equ 0x52        ;flag if eq switch pressed
eq_state     equ 0x53        ;eq on/off state

;*******************************************************************************
; Vector assignments
;*******************************************************************************
    org 00       ;Reset Vector
    goto     InitCode
    org 04       ;Interrupt Vector
    goto     ISR

;*******************************************************************************
; Interrupt Service Routine:
;*******************************************************************************
ISR:
    btfsc    STATUS,RP0       ;Check bank bit
    goto     ISR_bank1        ;If set, jump
    movwf    isr_W            ;else, already bank 0
    movf     STATUS,W         ;save W
    movwf    isr_STATUS       ;Save STATUS
    goto     ISR_cont         ;Jump to continue
ISR_bank1:
    bcf STATUS,RP0       ;Clear bank bit (bank 0)
    movwf    isr_W            ;save W
    movf     STATUS,W
    movwf    isr_STATUS       ;Save STATUS
    bsf isr_STATUS,RP0        ;Set bank bit in saved STATUS

ISR_cont:
    btfss    PIR1,ADIF        ;Check for A/D Interrupt
    goto     ISR_ret          ;Not A/D, jump to return
    bsf new_pot_flag,BIT0     ;Set new_pot_flag
    bcf PIR1,ADIF        ;Clear A/D int flag
    movlw    AD_CHAN_BITS         ;Pre-load A/D chan select bits
    andwf    ADCON0,W         ;Get A/D chan select bits in W
    btfss    STATUS,Z         ;Check for chan 0
    goto     ISR_AD1          ;If not 0 jump to check if chan 1
    movf     ADRES,W          ;Get A/D value
    movwf    new_pot0         ;Store new A/D reading
    movlw    NOT_AD_CHAN_BITS     ;Pre-load inverse of A/D chan bits
    andwf    ADCON0,W         ;Get ADCON0 and clear chan bits
    addlw    AD_CHAN1         ;Add value for chan 1
    movwf    ADCON0           ;Update ADCON0
    goto     ISR_ret          ;Done

ISR_AD1:
    movlw    AD_CHAN_BITS         ;Pre-load A/D chan select bits
    andwf    ADCON0,W         ;Get A/D chan select bits in W
    sublw    AD_CHAN1         ;Subtract chan 1
    btfss    STATUS,Z         ;Check for chan 1
    goto     ISR_AD2          ;If not 0 jump to check if chan 2
    movf     ADRES,W          ;Get A/D value
    movwf    new_pot1         ;Store new A/D reading
    movlw    NOT_AD_CHAN_BITS     ;Pre-load inverse of A/D chan bits
    andwf    ADCON0,W         ;Get ADCON0 and clear chan bits
    addlw    AD_CHAN2         ;Add value for chan 2
    movwf    ADCON0           ;Update ADCON0
    goto     ISR_ret          ;Done
ISR_AD2:
    movlw    AD_CHAN_BITS         ;Pre-load A/D chan select bits
    andwf    ADCON0,W         ;Get A/D chan select bits in W
    sublw    AD_CHAN2         ;Subtract chan 2
    btfss    STATUS,Z         ;Check for chan 2
    goto     ISR_AD3          ;If not 0 jump to check if chan 3
```

```
    movf    ADRES,W          ;Get A/D value
    movwf   new_pot2         ;Store new A/D reading
    movlw   NOT_AD_CHAN_BITS     ;Pre-load inverse of A/D chan bits
    andwf   ADCON0,W         ;Get ADCON0 and clear chan bits
    addlw   AD_CHAN3         ;Add value for chan 3
    movwf   ADCON0           ;Update ADCON0
    goto    ISR_ret          ;Done
ISR_AD3:
    movlw   AD_CHAN_BITS         ;Pre-load A/D chan select bits
    andwf   ADCON0,W         ;Get A/D chan select bits in W
    sublw   AD_CHAN3         ;Subtract chan 3
    btfss   STATUS,Z         ;Check for chan 3
    goto    ISR_AD4          ;If not 0 jump to check if chan 4
    movf    ADRES,W          ;Get A/D value
    movwf   new_pot3         ;Store new A/D reading
    movlw   NOT_AD_CHAN_BITS     ;Pre-load inverse of A/D chan bits
    andwf   ADCON0,W         ;Get ADCON0 and clear chan bits
    addlw   AD_CHAN4         ;Add value for chan 4
    movwf   ADCON0           ;Update ADCON0
    goto    ISR_ret          ;Done
ISR_AD4:
;   movlw   AD_CHAN_BITS         ;Pre-load A/D chan select bits
;   andwf   ADCON0,W         ;Get A/D chan select bits in W
;   btfss   STATUS,Z         ;Check for chan 0
;   goto    ISR_AD1          ;If not 0 jump to check if chan 1
    movf    ADRES,W          ;Get A/D value
    movwf   new_pot4         ;Store new A/D reading
    movlw   NOT_AD_CHAN_BITS     ;Pre-load inverse of A/D chan bits
    andwf   ADCON0,W         ;Get ADCON0 and clear chan bits
    addlw   AD_CHAN0         ;Add value for chan 0
    movwf   ADCON0           ;Update ADCON0

ISR_ret:
    btfsc   isr_STATUS,RP0       ;Check bank bit in saved STATUS
    goto    ISR_ret_bank1        ;If not set, jump
    movf    isr_STATUS,W
    movwf   STATUS           ;Restore STATUS
    movf    isr_W,W          ;Restore W
    retfie
ISR_ret_bank1:
    bcf isr_STATUS,RP0       ;Clear bank bit before restoring STATUS
    movf    isr_STATUS,W
    movwf   STATUS           ;Restore STATUS
    movf    isr_W,W          ;Restore W
    bsf STATUS,RP0       ;Reset bank bit (bank 1)
    retfie               ;Return (in Bank1), enables GIE

;*******************************************************************************
; Init Code:
;*******************************************************************************
InitCode:
    call    InitMem
    call    InitPorts
    call    InitI2C
    call    InitAD
    call    InitStartup_Params
    goto    MainLoop

;*******************************************************************************
; MainLoop:
;*******************************************************************************
MainLoop:
    call    CheckSwitches

    btfss   recall_flag,BIT0     ;Check recall flag
    goto    ML_chk_store         ;Jump if no recall press
```

```
    bcf recall_flag,BIT0     ;Else clear recall flag
    movlw   00h          ;EEPROM data address
    movwf   ee_addr
    call    ReadEEPROM       ;Input byte from EEPROM
    btfsc   err_bits,ERRORFLG   ;Check for error
    goto    errorloop
    movf    ee_rd_data,W         ;Get received byte
    movwf   Dpot_val
    bsf Dpot_flag,BIT0       ;set dpot flag
    movlw   NEW_READ         ;set pot status to show a new read
    movwf   pot_stat

ML_chk_store:
    btfss   store_flag,BIT0      ;check store button flag
    goto    ML_chk_eq        ;jump if store not pressed
    bcf store_flag,BIT0      ;else clear store flag
    movlw   00h          ;EEPROM data address
    movwf   ee_addr
    movf    Dpot_val,W
    movwf   ee_wr_data
    call    WriteEEPROM      ;Output byte to EEPROM
    btfsc   err_bits,ERRORFLG   ;Check for error
    goto    errorloop
    call    WriteEEPROMDelay     ;10mS Delay for 24LC01 EEPROM write

ML_chk_eq:
    btfss   eq_flag,BIT0         ;check eq switch flag
    goto    ML_cont          ;jump if eq switch not pressed
    bcf eq_flag,BIT0         ;else clear eq flag
    btfsc   eq_state,BIT0        ;check current eq state
    goto    ML_eq_on         ;jump if eq currently on
    bsf eq_state,BIT0        ;else set eq state to on
    bcf PORT_D,preamp_bit    ;disconnect preamp from output
    bsf PORT_D,eq_bit        ;connect eq to output
    goto    ML_cont
ML_eq_on:
    bcf eq_state,BIT0        ;set eq state to off
    bcf PORT_D,eq_bit        ;disconnect eq from output
    bsf PORT_D,preamp_bit    ;connect preamp to output

ML_cont:
    call    SetLeds
    call    CheckPots
    btfss   Dpot_flag,BIT0       ;Check Dpot_flag
    goto    MainLoop
    bcf Dpot_flag,BIT0       ;Clear Dpot_flag
    call    UpdateDpots
    goto    MainLoop

;*******************************************************************************
; CheckSwitches:
;   Input:  None
;   Output: Sets recall_flag and store_flag
;*******************************************************************************
CheckSwitches:
    decfsz  recall_sw_cnt        ;Decrement recall_sw debounce count
    goto    CS_store_sw      ;if cnt != 0, jump to read store_sw
    movlw   1
    movwf   recall_sw_cnt        ;Preset recall_sw_cnt to minimum count
    btfss   PORT_C,RECALL_SW     ;Check recall_sw
    goto    CS_recall_on         ;Pushed, jump
CS_recall_off:
    btfss   cur_recall_sw,0      ;Check current recall_sw state
    goto    CS_store_sw      ;Jump if recall_sw already OFF
    bcf cur_recall_sw,0      ;else update recall_sw state
    movlw   DEBOUNCE_CNT
```

```
    movwf   recall_sw_cnt       ;setup debounce count
    goto    CS_store_sw
CS_recall_on:
    btfsc   cur_recall_sw,0     ;Check current recall_sw state
    goto    CS_store_sw     ;Jump if recall_sw already ON
    bsf cur_recall_sw,0     ;else update recall_sw state
    bsf recall_flag,0       ;set recall flag
    movlw   DEBOUNCE_CNT
    movwf   recall_sw_cnt       ;setup debounce count

CS_store_sw:
    decfsz  store_sw_cnt        ;Decrement store_sw debounce count
    goto    CS_eq_sw        ;if cnt != 0, jump to read eq_sw
    movlw   1
    movwf   store_sw_cnt        ;Preset store_sw_cnt to minimum count
    btfss   PORT_A,STORE_SW     ;Check store_sw
    goto    CS_store_on     ;Pushed, jump
CS_store_off:
    btfss   cur_store_sw,0      ;Check current store_sw state
    goto    CS_eq_sw        ;Jump if store_sw already OFF
    bcf cur_store_sw,0      ;else update store_sw state
    movlw   DEBOUNCE_CNT
    movwf   store_sw_cnt        ;setup debounce count
    goto    CS_eq_sw
CS_store_on:
    btfsc   cur_store_sw,0      ;Check current store_sw state
    goto    CS_eq_sw        ;Jump if store_sw already ON
    bsf cur_store_sw,0      ;else update store_sw state
    bsf store_flag,0        ;set store flag
    movlw   DEBOUNCE_CNT
    movwf   store_sw_cnt        ;setup debounce count

CS_eq_sw:
    decfsz  eq_sw_cnt       ;Decrement eq_sw debounce count
    goto    CS_return       ;if cnt != 0, jump to return
    movlw   1
    movwf   eq_sw_cnt       ;Preset eq_sw_cnt to minimum count
    btfss   PORT_C,EQ_SW        ;Check eq_sw
    goto    CS_eq_on        ;Pushed, jump
CS_eq_off:
    btfss   cur_eq_sw,BIT0      ;Check current eq_sw state
    goto    CS_return       ;Jump if eq_sw already OFF
    bcf cur_eq_sw,BIT0      ;else update eq_sw state
    movlw   DEBOUNCE_CNT
    movwf   eq_sw_cnt       ;setup debounce count
    goto    CS_return
CS_eq_on:
    btfsc   cur_eq_sw,BIT0      ;Check current eq_sw state
    goto    CS_return       ;Jump if eq_sw already ON
    bsf cur_eq_sw,BIT0      ;else update eq_sw state
    bsf eq_flag,BIT0        ;set eq flag
    movlw   DEBOUNCE_CNT
    movwf   eq_sw_cnt       ;setup debounce count

CS_return:
    return

;*******************************************************************************
; SetLeds:
;*******************************************************************************
SetLeds:
;   btfsc   cur_recall_sw,0
;   goto    SL_recall_on
;   bcf PORT_B,RB0
;   goto    SL_chk_store
;SL_recall_on:
```

```
;   bsf PORT_B,RB0
;SL_chk_store:
;   btfsc   cur_store_sw,0
;   goto    SL_store_on
;   bcf PORT_B,RB1
;   goto    SL_return
;SL_store_on:
;   bsf PORT_B,RB1
;SL_return:

    movf    Dpot_val,W
    movwf   PORT_B

    return

;*******************************************************************************
; CheckPots:
;*******************************************************************************
CheckPots:
    btfss   new_pot_flag,BIT0
    goto    CP_ret
    bcf new_pot_flag,BIT0

    ;load pot values
    ;
    ;we should have flags set in ISR to indicate which pot was read.
    ;here we should determine from the flags which new_pot value
    ;to load. also need to deal with different pot_stat, last_pot,
    ;etc. Other way is repeating all code for each pot.
    ;
    movf    new_pot1,W
    movwf   new_pot
    movlw   0
    movwf   diff            ;Pre-load diff with 0

    movf    pot_stat,W      ;Load pot_stat
    sublw   READ_RATCHET        ;Check for pot_stat = READ_RATCHET
    btfsc   STATUS,Z        ;Check zero flag
    goto    CP_read_ratchet     ;Jump if zero flag is set
    movf    pot_stat,W      ;else reload pot_stat
    sublw   RATCHET_CW      ;Check for pot_stat = RATCHET_CW
    btfsc   STATUS,Z        ;Check zero flag
    goto    CP_ratchet_cw       ;Jump if zero flag is set
    movf    pot_stat,W      ;else reload pot_stat
    sublw   RATCHET_CCW     ;Check for pot_stat = RATCHET_CCW
    btfsc   STATUS,Z        ;Check zero flag
    goto    CP_ratchet_ccw      ;Jump if zero flag is set
                    ;else assume pot_stat = NEW_READ
CP_new_read:
    movf    new_pot,W
    movwf   last_pot        ;Save new_pot as last_pot
    movlw   READ_RATCHET
    movwf   pot_stat        ;Set pot_stat = READ_RATCHET
    goto    CP_use_diff

CP_read_ratchet:
    movf    new_pot,W
    subwf   last_pot,W
    btfsc   STATUS,Z        ;Check zero flag
    goto    CP_read_ratchet_0   ;Jump if (new_pot - last_pot) = 0
    addlw   1           ;Add 1
    btfsc   STATUS,Z        ;Check zero flag
    goto    CP_read_ratchet_0   ;Jump if (new_pot - last_pot + 1) = 0
    bcf STATUS,C        ;Make sure carry flag is clear
    rrf new_pot,W       ;Shift new_pot right and store in W
    movwf   diff            ;diff = new_pot >> 1
```

```
    bcf STATUS,C        ;Make sure carry flag is clear
    rrf last_pot,W      ;Shift last_pot right and store in W
    subwf   diff,F          ;diff = (new_pot >> 1) - (last_pot >> 1)
    movf    new_pot,W
    movwf   last_pot        ;last_pot = new_pot
    goto    CP_use_diff
CP_read_ratchet_0:
    movf    new_pot,F       ;Test new_pot
    btfss   STATUS,Z        ;Check zero flag
    goto    CP_read_ratchet_255 ;Jump if new_pot != 0
    movf    Dpot_val,F      ;Test Dpot_val
    btfsc   STATUS,Z        ;Check zero flag
    goto    CP_use_diff     ;Jump if Dpot = 0
    movlw   RATCHET_CW      ;else Dpot_val != 0, change pot_stat
    movwf   pot_stat        ;Set pot_stat = RATCHET_CW
    goto    CP_use_diff
CP_read_ratchet_255:
    movf    new_pot,W       ;Get new_pot
    sublw   0xFF            ;W = new_pot - 255
    btfss   STATUS,Z        ;Check zero flag
    goto    CP_use_diff     ;Jump if new_pot != 255
    movf    Dpot_val,W      ;Get Dpot_val
    sublw   0x7F            ;W = new_pot - 127
    btfsc   STATUS,Z        ;Check zero flag
    goto    CP_use_diff     ;Jump if Dpot = 127
    movlw   RATCHET_CCW     ;else Dpot_val != 127, change pot_stat
    movwf   pot_stat        ;Set pot_stat = RATCHET_CCW
    goto    CP_use_diff

CP_ratchet_cw:
    bcf STATUS,C        ;Make sure carry flag is clear
    rrf new_pot,W       ;W = new_pot >> 1
    movwf   diff            ;diff = new_pot >> 1
    movf    Dpot_val,W      ;Load Dpot_val in W
    subwf   diff,F          ;diff = (new_pot >> 1) - Dpot_val
    btfsc   STATUS,Z        ;Check zero flag
    goto    CP_ratchet_cw_nc
    btfsc   diff,BIT7       ;Check for negative value
    goto    CP_ratchet_cw_nc
    movf    new_pot,W       ;diff > 0 && (new_pot >> 1) > Dpot_val
    movwf   last_pot        ;Save new_pot as last_pot
    movlw   READ_RATCHET
    movwf   pot_stat        ;Set pot_stat = READ_RATCHET
    goto    CP_use_diff
CP_ratchet_cw_nc:
    movf    last_pot,W
    subwf   new_pot,W       ;W = new_pot - last_pot
    btfss   STATUS,C        ;Check carry flag
    goto    CP_ratchet_cw_ccw   ;Jump, new_pot < last_pot
    movf    new_pot,W       ;else, new_pot >= last_pot
    movwf   last_pot        ;Save new_pot as last_pot
    movlw   0
    movwf   diff            ;Clear diff
    goto    CP_use_diff
CP_ratchet_cw_ccw:
    movlw   0
    movwf   diff            ;Clear diff
    movf    new_pot,W
    addlw   4
    subwf   last_pot,W      ;W = ( new_pot + 4 ) - last_pot
    btfss   STATUS,C        ;Check carry flag
    goto    CP_use_diff     ;Jump, ( new_pot + 4 ) > last_pot
    bcf STATUS,C        ;Make sure carry flag is clear
    rrf new_pot,W       ;Shift new_pot right and store in W
    movwf   diff            ;diff = new_pot >> 1
    bcf STATUS,C        ;Make sure carry flag is clear
```

```
    rrf last_pot,W      ;Shift last_pot right and store in W
    subwf   diff,F          ;diff = (new_pot >> 1) - (last_pot >> 1)
    movf    new_pot,W
    movwf   last_pot        ;last_pot = new_pot
    movlw   READ_RATCHET
    movwf   pot_stat        ;Set pot_stat = READ_RATCHET
    goto    CP_use_diff

CP_ratchet_ccw:
    bcf STATUS,C        ;Make sure carry flag is clear
    rrf new_pot,W       ;W = new_pot >> 1
    movwf   diff            ;diff = new_pot >> 1
    movf    Dpot_val,W      ;Load Dpot_val in W
    subwf   diff,F          ;diff = (new_pot >> 1) - Dpot_val
    btfss   diff,BIT7       ;Check for negative value
    goto    CP_ratchet_ccw_nc   ;
    movf    new_pot,W       ;diff < 0 && (new_pot >> 1) < Dpot_val
    movwf   last_pot        ;Save new_pot as last_pot
    movlw   READ_RATCHET
    movwf   pot_stat        ;Set pot_stat = READ_RATCHET
    goto    CP_use_diff
CP_ratchet_ccw_nc:
    movf    new_pot,W
    subwf   last_pot,W      ;W = last_pot - new_pot
    btfss   STATUS,C        ;Check carry flag
    goto    CP_ratchet_ccw_cw   ;Jump, new_pot > last_pot
    movf    new_pot,W       ;else, new_pot <= last_pot
    movwf   last_pot        ;Save new_pot as last_pot
    movlw   0
    movwf   diff            ;Clear diff
    goto    CP_use_diff
CP_ratchet_ccw_cw:
    movlw   0
    movwf   diff            ;Clear diff
    bcf new_pot,BIT0        ;new_pot &= 0xFE
    movf    last_pot,W
    sublw   0
    movwf   temp            ;convert last_pot to a positive value
    movf    new_pot,W
    sublw   0           ;convert new_pot to a positive value
    addlw   4
    subwf   temp,W          ;W = ( new_pot + 4 ) - last_pot
    btfss   STATUS,C        ;Check carry flag
    goto    CP_use_diff     ;Jump, ( last_pot + 4 ) > new_pot
    bcf STATUS,C        ;Make sure carry flag is clear
    rrf new_pot,W       ;Shift new_pot right and store in W
    movwf   diff            ;diff = new_pot >> 1
    bcf STATUS,C        ;Make sure carry flag is clear
    rrf last_pot,W      ;Shift last_pot right and store in W
    subwf   diff,F          ;diff = (new_pot >> 1) - (last_pot >> 1)
    movf    new_pot,W
    movwf   last_pot        ;last_pot = new_pot
    movlw   READ_RATCHET
    movwf   pot_stat        ;Set pot_stat = READ_RATCHET

CP_use_diff:
    movf    diff,F          ;Try to set zero flag
    btfss   STATUS,Z        ;Check zero flag
    bsf Dpot_flag,BIT0      ;Set flag for change in pot
    btfsc   diff,BIT7       ;Check for negative diff
    goto    CP_neg_diff     ;Jump if diff is negative
    movf    diff,W          ;Load positive diff in W
    addwf   Dpot_val,F      ;Dpot_val = Dpot_val + diff
    btfss   Dpot_val,BIT7       ;Check for rollover
    goto    CP_ret
    movlw   0x7F
```

```
    movwf   Dpot_val        ;Limit Dpot_val to 127
    goto    CP_ret
CP_neg_diff
    movf    diff,W          ;Load negative diff in W
    addwf   Dpot_val,F      ;Dpot_val = Dpot_val + diff
    btfsc   Dpot_val,BIT7       ;Check for underflow
    clrf    Dpot_val        ;Limit Dpot_val to 0

CP_ret:
    call    DelayAD
    call    DelayAD
    bsf     ADCON0,GO   ;Start next A/D conversion
    return

;*******************************************************************************
; InitMem: Clears memory (bank 0, then bank 1) and initializes variables
;*******************************************************************************
InitMem:
    movlw   0x20        ;Start above special function registers
    movwf   FSR     ;Load FSR
IM_clear_mem:
    clrf    INDF        ;Clear where FSR is pointing
    incf    FSR     ;inc FSR
    btfss   FSR,7       ;Check for end of memory
    goto    IM_clear_mem    ;Loop until EOM

    movlw   0x60
    movwf   temp
    movlw   0xA0        ;Start above special function registers
    movwf   FSR     ;Load FSR
IM_clear_mem2:
    bsf STATUS,RP0  ;Bank 1
    clrf    INDF        ;Clear where FSR is pointing
    incf    FSR     ;inc FSR
    bcf STATUS,RP0  ;Bank 0
    decfsz  temp
    goto    IM_clear_mem2   ;Loop until EOM

    movlw   1
    movwf   recall_sw_cnt   ;preset recall debounce count to minimum
    movwf   store_sw_cnt    ;preset store debounce count to mimimum
    movlw   0x40
    movwf   Dpot_val    ;start with vol at half
    return

;*******************************************************************************
; InitAD: Initializes and sets up the A/D hardware.
;     Select ch0 to ch3 as analog inputs, RC clock, and read ch0.
;*******************************************************************************
InitAD:
    bcf INTCON,GIE  ;Disable Global Interrupts
    bsf STATUS,RP0  ;Bank 1
    movlw   B'00000010' ;RA0,RA1,RA4 analog inputs
    movwf   ADCON1          ;
    bsf PIE1,ADIE   ;Enable A/D Interrupt
    bcf STATUS,RP0  ;Bank 0
    movlw   0C1h            ;Select RC osc, Analog inp 0
    movwf   ADCON0
    bcf PIR1,ADIF   ;Clear A/D int flag
    bsf INTCON,PEIE ;Enable peripheral Interrupts
    bsf INTCON,GIE  ;Enable Global Interrupts
    call    DelayAD     ;Delay for A/D
    bsf     ADCON0,GO       ;Start A/D conversion
    return

;*******************************************************************************
```

```
; InitI2C: Initializes and sets up I2C bus for communicating to EEPROM
;*****************************************************************************
InitI2C:
    bcf     INTCON,GIE      ;Disable Global Interrupts
    clrf    err_bits
    bsf STATUS,RP0  ;Bank 1
    bsf TRIS_C,SDA  ;Set SDA as input
    bsf TRIS_C,SCL  ;Set SCL as input
    bcf PIE1, SSPIE ;Disable SSP Interrupt
    bcf STATUS,RP0  ;Bank 0
    bcf PIR1, SSPIF ;Clear SSP Interrupt flag
    movlw   B'00111011' ;I2C master mode enabled
    bcf PORT_C, SDA ;Set SDA to low when not in tri-state
    bcf PORT_C, SCL ;Set SCL to low when not in tri-state
    clrf    PORT_C
    bsf     INTCON,GIE      ;Enable Global Interrupts
    return

;*****************************************************************************
; InitPorts: Inits various port pins
;   port pins inited elsewhere:
;       TRIS_C,RC3;
;*****************************************************************************
InitPorts:
    bsf STATUS,RP0      ;Bank 1
    clrf    TRIS_B          ;Set Port_B output
    bsf TRIS_A, RA4     ;Set RA4 as input, switch
    bsf TRIS_C, RC0     ;Set RC0 as input, switch
    bsf TRIS_C, RC1     ;Set RC1 as input, switch
    bsf TRIS_C, RC2     ;Set RC2 as input, switch
    bsf TRIS_C, RC5     ;Set RC5 as input, switch
;   bsf TRIS_C, RC6     ;Set RC6 as input, switch, not on demo
;   bsf TRIS_C, RC7     ;Set RC7 as input, switch, not on demo
    clrf    TRIS_D          ;Set Port_D output
    bcf STATUS,RP0      ;Bank 0
    movlw   0
    movwf   PORT_B          ;Set Port B low
    bcf PORT_D,eq_bit       ;eq disconnected on startup
    bcf PORT_D,preamp_bit   ;preamp disconnected on startup
    return

;*****************************************************************************
; InitStartup_Params: reads startup settings from EEPROM
;*****************************************************************************
InitStartup_Params:
    movlw   0           ;eeprom address 0
    movwf   ee_addr         ;Read EEPROM for starting value
    call    ReadEEPROM      ;Input byte from EEPROM
    btfsc   err_bits,ERRORFLG   ;Check for error
    goto    errorloop
    movf    ee_rd_data,W        ;Get received byte
    movwf   Dpot_val        ;Update Dpot_val
    bsf Dpot_flag,BIT0      ;Set new Dpot_val flag
    return

;*****************************************************************************
; UpdateDpots:
;*****************************************************************************
UpdateDpots:
    bcf PORT_D,DPOT_LOAD_BIT    ;Set load line low, start loading
    movlw   DPOT_CHAN1
    movwf   Dpot1_byte
    movwf   Dpot2_byte
    movwf   Dpot3_byte
    call    ByteXmitDpots       ;Xmit chan
;   movf    Dpot_val,W
```

```
    rlf Dpot_val,W
    movwf   Dpot1_byte
    movwf   Dpot2_byte
    movwf   Dpot3_byte
    call    ByteXmitDpots       ;Xmit data
    bsf PORT_D,DPOT_LOAD_BIT    ;Set load line high, finished loading
    return

;*******************************************************************************
; ByteXmitDpots:
;   Input:  Dpot1_byte, Dpot2_byte, Dpot3_byte
;   Output: Dpot_bytes written to Digital Pots
;*******************************************************************************
ByteXmitDpots:
    movlw   8           ;Set loop counter for eight bits
    movwf   loop_cnt
WD_loop:
    bcf PORT_D,DPOT_CLK_BIT ;Start w/ clock low
    btfsc   Dpot1_byte,BIT7     ;Test MSB of Dpot1
    goto    WD_Dpot1_high       ;Jump if high
    bcf PORT_D,DPOT1_BIT    ;Clear bit for Dpot1
    goto    WD_test_Dpot2
WD_Dpot1_high:
    bsf PORT_D,DPOT1_BIT    ;Set bit for Dpot1
WD_test_Dpot2:
    btfsc   Dpot2_byte,BIT7     ;Test MSB of Dpot2
    goto    WD_Dpot2_high       ;Jump if high
    bcf PORT_D,DPOT2_BIT    ;Clear bit for Dpot2
    goto    WD_test_Dpot3
WD_Dpot2_high:
    bsf PORT_D,DPOT2_BIT    ;Set bit for Dpot2
WD_test_Dpot3:
    btfsc   Dpot3_byte,BIT7     ;Test MSB of Dpot3
    goto    WD_Dpot3_high       ;Jump if high
    bcf PORT_D,DPOT3_BIT    ;Clear bit for Dpot3
    goto    WD_clock_data
WD_Dpot3_high:
    bsf PORT_D,DPOT3_BIT    ;Set bit for Dpot3
WD_clock_data:
    bsf PORT_D,DPOT_CLK_BIT ;Clock data w/ rising edge
    rlf Dpot1_byte      ;Rotate left
    rlf Dpot2_byte      ;Rotate left
    rlf Dpot3_byte      ;Rotate left
    decfsz  loop_cnt        ;8 bits done?
    goto    WD_loop         ;No
    return

;*******************************************************************************
; WriteEEPROM: Write a byte on I2C bus to EEPROM
;*******************************************************************************
;   Input:  ee_wr_data = data to be written
;       ee_addr = EEPROM data address
;   Output: Data written to EEPROM
;*******************************************************************************
WriteEEPROM:
    movlw   EEPROM_WR   ;Put EEPROM chip address in W (WRITE)
    movwf   xmit_buf    ;in xmit buffer
    call    StartXmitI2C    ;Generate START bit
    call    ByteXmitI2C ;Xmit chip address
    movf    ee_addr,W   ;Put data address
    movwf   xmit_buf    ;in xmit buffer
    call    ByteXmitI2C ;Xmit data address
    movf    ee_wr_data,W    ;Move data
    movwf   xmit_buf    ;into buffer
    call    ByteXmitI2C ;Xmit data
    call    StopXmitI2C ;Generate STOP bit
```

```
    return

;*****************************************************************************
; ReadEEPROM: Read a byte from EEPROM on I2C bus
;*****************************************************************************
;   Input:  ee_addr = source address
;   Output: ee_rd_data = data read from serial EEPROM
;*****************************************************************************
ReadEEPROM:
    movlw   EEPROM_WR    ;Put EEPROM chip address in W (WRITE)
    movwf   xmit_buf     ;in xmit buffer
    call    StartXmitI2C     ;Generate START bit
    call    ByteXmitI2C ;Xmit chip address
    movf    ee_addr,W    ;Put data address
    movwf   xmit_buf     ;in xmit buffer
    call    ByteXmitI2C ;Xmit data address
    call    StartXmitI2C     ;START READ
    movlw   EEPROM_RD    ;Put EEPROM chip address in W (READ)
    movwf   xmit_buf     ;in xmit buffer
    call    ByteXmitI2C ;Output chip address
    call    ByteRcvI2C   ;READ in data and acknowledge
    call    StopXmitI2C ;Generate STOP bit
    movf    rcv_buf,W    ;Save data from buffer
    movwf   ee_rd_data   ;to ee_rd_data
    return

;*****************************************************************************
; ByteXmitI2C: Transmit 8 bits on I2C bus
;*****************************************************************************
;   Input:  xmit_buf
;   Output: Data transmitted to EEPROM device
;*****************************************************************************
ByteXmitI2C:
    movlw   8        ;Set counter for eight bits
    movwf   loop_cnt
ByX_loop:
    bcf i2c_bits,DO ;Default 0 bit out
    btfsc   xmit_buf,7   ;If shifted bit = 0, data bit = 0
    bsf i2c_bits,DO ;otherwise data bit = 1
    call    BitXmitI2C   ;Send bit
    rlf xmit_buf     ;Rotate xmit_buf left
    decfsz  loop_cnt     ;8 bits done?
    goto    ByX_loop     ;No
    call    BitRcvI2C    ;Read acknowledge bit
    movlw   3
    btfsc   i2c_bits,DI ;Check for acknowledge
    call    I2C_ERR      ;No acknowledge, report error
    return

;*****************************************************************************
; ByteRcvI2C: Receive 8 bits from I2C bus
;*****************************************************************************
;   Input:  None
;   Output: rcv_buf = 8-bit data received
;*****************************************************************************
ByteRcvI2C:
    movlw   8        ;8 bits of data
    movwf   loop_cnt
ByR_loop:
    rlf rcv_buf      ;Shift new data in buffer
    bcf rcv_buf,0    ;Preset bit = 0
    call    BitRcvI2C    ;Receive bit
    btfsc   i2c_bits,DI ;Test bit
    bsf rcv_buf,0    ;if DI set, set bit = 1
    decfsz  loop_cnt     ;Check count
    goto    ByR_loop     ;Loop if count != 0
```

```
    bsf i2c_bits,DO ;Set acknowledge bit = 1
    call    BitXmitI2C  ;to STOP further input
    return

;*******************************************************************************
; BitXmitI2C: xmit single bit on I2C bus to EEPROM
;   Input:  i2c_bits register, bit DO
;   Output: Bit transmitted over I2C, error bits set as necessary
;*******************************************************************************
BitXmitI2C:
    btfsc   i2c_bits,DO ;Test xmit bit
    goto    BiX_high    ;Jump if bit = 1
    bsf STATUS,RP0  ;bank 1
    bcf TRIS_C,SDA  ;Set SDA to output (0): bit = 0
    bcf STATUS,RP0  ;Bank 0
    nop         ;Delay
    goto    BiX_clock   ;Goto clock data
BiX_high:
    bsf STATUS,RP0  ;Bank 1
    bsf TRIS_C,SDA  ;Set SDA to input (1): bit = 1
    bcf STATUS,RP0  ;Bank 0
    movlw   2       ;Pre-load error code 2
    btfss   PORT_C,SDA  ;Read SDA, check if not high?
    call    I2C_ERR     ;Yes, set error
BiX_clock:
    bsf STATUS,RP0  ;Bank 1
    bsf TRIS_C,SCL  ;Set SCL to input (1): bit = 1
    bcf STATUS,RP0  ;Bank 0
    movlw   1           ;Pre-load error code 1
    btfss   PORT_C,SCL  ;Read SCL, check if not high?
    call    I2C_ERR     ;Yes, set error
    nop         ;Timing delay
    nop         ;Timing delay
    bsf STATUS,RP0  ;Bank 1
    bcf TRIS_C,SCL      ;Set SCL to output (0): bit = 0
    bcf STATUS,RP0  ;Bank 0
    return

;*******************************************************************************
; BitRcvI2C: Receive a bit from EEPROM on I2C bus
;*******************************************************************************
;   Input:  None
;   Output: Data bit received
;*******************************************************************************
BitRcvI2C:
    bsf STATUS,RP0  ;bank 1
    bsf TRIS_C,SDA  ;Set SDA to input (1): bit = 1
    bcf STATUS,RP0  ;Bank 0
    bcf i2c_bits,DI ;Preset DI = 0
    bsf STATUS,RP0  ;Bank 1
    bsf TRIS_C,SCL  ;Set SCL to input (1): bit = 1, clock high
    bcf STATUS,RP0  ;Bank 0
    movlw   1       ;Pre-load error code 1
    btfss   PORT_C,SCL  ;Read SCL, check if not high?
    call    I2C_ERR     ;if low, set error
    btfsc   PORT_C,SDA  ;Check data bit on SDA pin
    bsf i2c_bits,DI ;if high, set DI = 1
    nop         ;Delay
    bsf STATUS,RP0  ;Bank 1
    bcf TRIS_C,SCL      ;Set SCL to output (0): bit = 0
    bcf STATUS,RP0  ;Bank 0
    return

;*******************************************************************************
; StartXmitI2C: Generate start bit for I2C bus
;       SCL is high while SDA goes from high to low transition.
```

```
;       Check status of the serial clock.
;*******************************************************************************
StartXmitI2C:
    bsf STATUS,RP0   ;Bank 1
    bsf TRIS_C,SDA   ;Set SDA to input (1): bit = 1
    bsf TRIS_C,SCL   ;Set SCL to input (1): bit = 1
    bcf STATUS,RP0   ;Bank 0
    movlw   1                ;Pre-load error code 1
    btfss   PORT_C,SCL   ;Read SCL, check if not high?
    call    I2C_ERR      ;SCL locked low by device, flag error
    bsf STATUS,RP0   ;Bank 1
    bcf TRIS_C,SDA   ;Set SDA to output (0): bit = 0, while SCL high
    nop          ;Timing adjustment, 1uS @4MHz
    nop          ;Timing adjustment, 1uS @4MHz
    bcf TRIS_C,SCL   ;Set SCL to output (0): bit = 0, start clocking
    bcf STATUS,RP0   ;Bank 0
    return

;*******************************************************************************
; StopXmitI2C:  Generate stop bit for I2C bus
;       SDA goes from low to high during SCL high state
;       Check bus conditions.
;*******************************************************************************
StopXmitI2C:
    bsf STATUS,RP0   ;Bank 1
    bcf TRIS_C,SDA   ;Set SDA to output (0): bit = 0, insure low
    bsf TRIS_C,SCL   ;Set SCL to input (1): bit = 1, while SDA low
    bcf STATUS,RP0   ;Bank 0
    nop
    movlw   1        ;Pre-load error code 1
    btfss   PORT_C,SCL   ;Read SCL, check if not high?
    call    I2C_ERR      ;No, SCL locked low by device, flag error
    bsf STATUS,RP0   ;Bank 1
    bsf TRIS_C,SDA   ;Set SDA to input (1): bit = 1, while SCL high
    bcf STATUS,RP0   ;Bank 0
    movlw   4        ;Pre-load error code 4
    btfss   PORT_C,SDA   ;Read SDA, check if not high?
    call    I2C_ERR      ;No, SDA bus not release for STOP
    return

;*******************************************************************************
; I2C_ERR: I2C bus error status table and subroutine
;*******************************************************************************
;   input:  W-reg = error code
;   output: err_bits = error code
;
;         code          error status mode
;       -------         ----------------------------------------------------
;           1   :       SCL locked low by device (bus is still busy)
;           2   :       SDA locked low by device (bus is still busy)
;           3   :       No acknowledge from device (no handshake)
;           4   :       SDA bus not released for master to generate STOP bit
;
;*******************************************************************************
; Subroutine to identify the status of the serial clock (SCL) and serial data
; (SDA) condition according to the error status table. Codes generated are
; useful for bus/device diagnosis.
;*******************************************************************************
I2C_ERR:
    bcf STATUS,RP0
    btfss   err_bits,ERRORFLG   ;If not first error, do not change code
    movwf   err_bits        ;Save error code
    bsf err_bits,ERRORFLG   ;Set error flag
    return

;*******************************************************************************
```

```
; This routine is a software delay of 10uS for the A/D setup.
; At 4Mhz clock, the loop takes 3uS, so initialize temp with
; a value of 3 to give 9uS, plus the move etc should result in
; a total time of > 10uS.
;*******************************************************************************
DelayAD:
    movlw   .3              ;Load Temp with decimal 3
    movwf   temp
DAD_loop:
    decfsz  temp            ;Delay loop
    goto    DAD_loop
    return

;*******************************************************************************
; WriteEEPROMDelay: Provide a 10.78mS delay for EEPROM writes
;*******************************************************************************
WriteEEPROMDelay:
    bcf STATUS,RP0
    movlw   7
    movwf   temp1
    clrf    temp            ;clear last location
dly1:
    nop
    nop
    nop
    decfsz  temp            ;reduce count
    goto    dly1            ;Inner loop time = 1.54mS
    decfsz  temp1
    goto    dly1        ;Total time = 10.78mS
    return

;*******************************************************************************
; errorloop:
;*******************************************************************************
errorloop:
    clrf    PORT_B          ;Turn off all LEDs
errloop1:
    call    WriteEEPROMDelay    ;Delay so that flashing of LEDs
    call    WriteEEPROMDelay    ;is apparent
    call    WriteEEPROMDelay
    call    WriteEEPROMDelay
    call    WriteEEPROMDelay
    call    WriteEEPROMDelay
    comf    PORT_B          ;Change state of all LEDs
    goto    errloop1

;*******************************************************************************

    END
```

```
;*****************************************************************************
; FILE: reg.inc - registers in PIC16C74
;*****************************************************************************
    NOLIST

;*****************************************************************************
; BANK 0 Registers:
;*****************************************************************************
TMR0     equ 0x01
PCL      equ 0x02
STATUS   equ 0x03
FSR      equ 0x04
PORT_A   equ 0x05
PORT_B   equ 0x06
PORT_C   equ 0x07
PORT_D   equ 0x08
PORT_E   equ 0x09
PCLATH   equ 0x0A
INTCON   equ 0x0B
PIR1     equ 0x0C
PIR2     equ 0x0D
TMR1L    equ 0x0E
TMR1H    equ 0x0F
T1CON    equ 0x10
TMR2     equ 0x11
T2CON    equ 0x12
SSPBUF   equ 0x13
SSPCON   equ 0x14
CCPR1L   equ 0x15
CCPR1H   equ 0x16
CCP1CON  equ 0x17
RCSTA    equ 0x18
TXREG    equ 0x19
RCREG    equ 0x1A
CCPR2L   equ 0x1B
CCPR2H   equ 0x1C
CCP2CON  equ 0x1D
ADRES    equ 0x1E
ADCON0   equ 0x1F

;*****************************************************************************
; BANK 1 Registers:
;*****************************************************************************
;OPTION equ 0x01
TRIS_A   equ 0x05
TRIS_B   equ 0x06
TRIS_C   equ 0x07
TRIS_D   equ 0x08
TRIS_E   equ 0x09
PIE1     equ 0x0C
PIE2     equ 0x0D
PCON     equ 0x0E
PR2 equ 0x12
SSPADD   equ 0x13
SSPSTAT  equ 0x14
TXSTA    equ 0x18
SPBRG    equ 0x19
ADCON1   equ 0x1F

;*****************************************************************************
; STATUS Reg Bits
;*****************************************************************************
CARRY    equ 0x00
C    equ 0x00
DCARRY   equ 0x01
DC   equ 0x01
```

```
Z_bit    equ 0x02
Z    equ 0x02
P_DOWN   equ 0x03
PD   equ 0x03
T_OUT    equ 0x04
TO   equ 0x04
RP0  equ 0x05

;*****************************************************************************
; OPTION Reg Bits
;*****************************************************************************
PS0  equ 0x00
PS1  equ 0x01
PS2  equ 0x02
PSA  equ 0x03
RTE  equ 0x04
RTS  equ 0x05
INTEDG   equ 0x06
RBPU     equ 0x07

;*****************************************************************************
; INTCON Reg Bits
;*****************************************************************************
RBIF     equ 0x00
INTF     equ 0x01
TOIF     equ 0x02
RBIE     equ 0x03
INTE     equ 0x04
TOIE     equ 0x05
PEIE     equ 0x06
GIE  equ 0x07

;*****************************************************************************
; PIE1 Reg Bits
;*****************************************************************************
TMR1IE   equ 0x00
TMR2IE   equ 0x01
CCP1IE   equ 0x02
SSPIE    equ 0x03
TXIE     equ 0x04
RCIE     equ 0x05
ADIE     equ 0x06
PSPIE    equ 0x07

;*****************************************************************************
; PIR1 Reg Bits
;*****************************************************************************
TMR1IF   equ 0x00
TMR2IF   equ 0x01
CCP1IF   equ 0x02
SSPIF    equ 0x03
TXIF     equ 0x04
RCIF     equ 0x05
ADIF     equ 0x06
PSPIF    equ 0x07

;*****************************************************************************
; SSPSTAT Reg Bits
;*****************************************************************************
BF   equ 0x00          ;Buffer Full
UA   equ 0x01          ;Update Address
RW   equ 0x02          ;Read/!Write
S    equ 0x03          ;Start
P    equ 0x04          ;Stop
DA   equ 0x05          ;Data/!Address
```

```
;*************************************************************************
; SSPCON Reg Bits
;*************************************************************************
SSPM0    equ 0x00
SSPM1    equ 0x01
SSPM2    equ 0x02
SSPM3    equ 0x03
CKP equ 0x04
SSPEN    equ 0x05
SSPOV    equ 0x06
WCOL     equ 0x07

;*************************************************************************
; PORT_A Reg Bits
;*************************************************************************
RA0 equ 0x00
RA1 equ 0x01
RA2 equ 0x02
RA3 equ 0x03
RA4 equ 0x04
RA5 equ 0x05

;*************************************************************************
; PORT_B Reg Bits
;*************************************************************************
RB0 equ 0x00
RB1 equ 0x01
RB2 equ 0x02
RB3 equ 0x03
RB4 equ 0x04
RB5 equ 0x05
RB6 equ 0x06
RB7 equ 0x07

;*************************************************************************
; PORT_C Reg Bits
;*************************************************************************
RC0 equ 0x00
RC1 equ 0x01
RC2 equ 0x02
RC3 equ 0x03
RC4 equ 0x04
RC5 equ 0x05
RC6 equ 0x06
RC7 equ 0x07

;*************************************************************************
; PORT_D Reg Bits
;*************************************************************************
RD0 equ 0x00
RD1 equ 0x01
RD2 equ 0x02
RD3 equ 0x03
RD4 equ 0x04
RD5 equ 0x05
RD6 equ 0x06
RD7 equ 0x07

;*************************************************************************
; General Bits
;*************************************************************************
BIT0     equ 0x00
BIT1     equ 0x01
BIT2     equ 0x02
BIT3     equ 0x03
BIT4     equ 0x04
```

```
BIT5     equ 0x05
BIT6     equ 0x06
BIT7     equ 0x07

;*****************************************************************************

    LIST
```

```
;*****************************************************************************
; FILE: pre.inc - equates for pre.a
;
;*****************************************************************************
W   equ 0x00        ;needed for movf to wreg
F   equ 0x01        ;needed for swapf to self
INDF    equ 0x00        ;needed indirect addressing


LSB     equ     0x00
MSB     equ     0x07

TRUE    equ     0x01
FALSE   equ     0x00

YES     equ     0x01
NO      equ     0x00


;*****************************************************************************
; switch reading bits and values
;*****************************************************************************
RECALL_SW   equ RC2 ;pin for recall switch
STORE_SW    equ RA4 ;pin for Store switch
EQ_SW       equ RC0 ;pin for eq switch
DEBOUNCE_CNT    equ 0x20    ;count value for debouncing

;*****************************************************************************
; AD bits
;*****************************************************************************
AD_CHAN_BITS        equ 0x38
NOT_AD_CHAN_BITS    equ 0xC7
GO          equ 0x02    ;A/D GO/DONE flag bit
AD_CHAN0        equ 0x00
AD_CHAN1        equ 0x08
AD_CHAN2        equ 0x10
AD_CHAN3        equ 0x18
AD_CHAN4        equ 0x20

;*****************************************************************************
; Pot status bits
;*****************************************************************************
NEW_READ    equ 0x00
READ_RATCHET    equ 0x01
RATCHET_CW  equ 0x02
RATCHET_CCW equ 0x03

;*****************************************************************************
; Digital pot bits
;*****************************************************************************
DPOT_CHAN1  equ 0x00
DPOT_CHAN2  equ 0x01
DPOT1_BIT   equ 0x00
DPOT2_BIT   equ 0x01
DPOT3_BIT   equ 0x02
DPOT_CLK_BIT    equ 0x03
DPOT_LOAD_BIT   equ 0x04


;*****************************************************************************
; EEPROM bits and values
;*****************************************************************************
EEPROM_WR   equ 0xA0    ;I2C bus EEPROM chip address + WRITE
EEPROM_RD   equ 0xA1    ;I2C bus EEPROM chip address + READ
```

```
;*******************************************************************************
; err_bits
;*******************************************************************************
ERRORFLG equ    0       ;error flag


;*******************************************************************************
; i2c_bits Bits
;*******************************************************************************
DI  equ 7       ;EEPROM input
DO  equ 6       ;EEPROM output
SCL equ 3       ;RC3, serial clock
SDA equ 4       ;RC4, data in/out


;*******************************************************************************
; eq switching bits
;*******************************************************************************
eq_bit      equ 0x06
preamp_bit  equ     0x05


;*******************************************************************************
; Bit Assignments
;*******************************************************************************
```

```
;*****************************************************************************
; general purpose register assignments
;        -master list of registers and variables
;
; 0x20      temp            Temporary storage variable
; 0x21      i2c_bits        Bit buffer
; 0x22      err_bits        Common flag bits register
; 0x23      ee_addr         Address register
; 0x24      ee_rd_data      Stored data input register
; 0x25      ee_wr_data      Stored data output register
; 0x26
; 0x27      xmit_buf        EEPROM xmit buffer
; 0x28      rcv_buf         EEPROM recieve buffer
; 0x29      loop_cnt        Bit counter
; 0x2A
; 0x2B      temp1           More Temporary storage
; 0x2C      new_pot         working variable for pot check routine
; 0x2D      last_pot        working variable for pot check routine
; 0x2E      cur_pot         not used anywhere
; 0x2F      cur_recall_sw       current state of recall switch
; 0x30      recall_sw_cnt       recall switch debounce counter
; 0x31      recall_flag     flag if recall pressed
; 0x32      cur_store_sw        current state of store switch
; 0x33      store_sw_cnt        store switch debounce counter
; 0x34      store_flag      flag if store switch pressed
; 0x35      isr_W           for storing w while in ISR
; 0x36      isr_STATUS      for storing status while in ISR
; 0x37      pot_stat        determines current pot ratcheting status
; 0x38      Dpot_val        current digital pot value
; 0x39      new_pot_flag        flag indicating new pot a/d read - ISR
; 0x3A      diff            difference between current and last read
; 0x3B
; 0x3C
; 0x3D
; 0x3E
; 0x3F
; 0x40      Dpot1_byte      byte to send to digpot 1
; 0x41      Dpot2_byte      byte to send to digpot 2
; 0x42      Dpot3_byte      byte to send to digpot 3
; 0x43      Dpot_flag       flag if new value avail. for dpots
; 0x44      new_pot0        value of pot0 a/d reading - ISR
; 0x45      new_pot1        value of pot1 a/d reading - ISR
; 0x46      new_pot2        value of pot2 a/d reading - ISR
; 0x47      new_pot3        value of pot3 a/d reading - ISR
; 0x48      new_pot4        value of pot4 a/d reading - ISR
; 0x49
; 0x4A
; 0x4B
; 0x4C
; 0x4D
; 0x4E
; 0x4F
; 0x50      cur_eq_sw       current state of eq switch
; 0x51      eq_sw_cnt       eq switch debounce counter
; 0x52      eq_flag         flag if eq switch pressed
; 0x53      eq_state        eq on/off state
; 0x54
; 0x55
; 0x56
; 0x57
; 0x58
; 0x59
; 0x5A
; 0x5B
; 0x5C
; 0x5D
```

```
; 0x5E
; 0x5F
;
;
;
;
;
;
;
;*****************************************************************************
```

What is claimed is:

1. Electric stringed musical instrument apparatus, comprising:

a manually operable analog tone-control member adapted to mount on an electric stringed musical instrument;

a manually operable analog volume-control member adapted to mount on the electric stringed musical instrument;

an analog circuit adapted to mount on the electric stringed musical instrument to process, within the analog domain, an analog electric signal generated by the electric stringed musical instrument; and a digital control circuit adapted to connect to said tone-control member, said volume-control member, and said analog circuit on the electric stringed musical instrument such that said digital control circuit digitally controls tone and volume characteristics of said analog circuit in response to analog signals from said tone-control member and said volume-control member.

2. Apparatus as defined in claim 1, wherein:

said digital control circuit includes a memory in which to store a preset combination of tone and volume control information defined in response to analog signals from said tone-control member and said volume-control member; and said apparatus further comprises a manually operable switch connected to said digital control circuit such that actuation of said switch causes said digital control circuit to control said analog circuit in response to the stored preset combination of tone and volume control information.

3. Apparatus as defined in claim 2, wherein said switch is connected with and operable through one of said tone-control member and volume-control member.

4. Apparatus as defined in claim 3, further comprising a status indicator connected to said digital control circuit and responsive to operation of said switch.

5. Apparatus as defined in claim 2, further comprising a status indicator connected to said digital control circuit and responsive to operation of said switch.

6. Apparatus as defined in claim 1, wherein said digital control circuit includes means for controlling electrical energization of at least part of said digital control circuit in response to use of the instrument.

7. Apparatus as defined in claim 6, wherein said means for controlling electrical energization includes means for generating a power utilization control signal for said digital control circuit in response to movement of a string of the instrument.

8. In an electric stringed musical instrument including manually operable analog tone and volume controls and a pickup which generates an analog electric signal in response to movement of one or more strings of the instrument, the improvement comprising a digitally controlled analog circuit which separately and sequentially modifies, within the analog domain under digital control, analog tone and volume characteristics of the analog electric signal from the pickup in response to settings of the analog tone and volume controls.

9. The improvement of claim 8, further comprising a digital memory having storage locations for predetermined tone and volume control information, said digital memory connected to said digitally controlled analog circuit such that said analog circuit is responsive to predetermined tone and volume control information stored in the storage locations of said digital memory.

10. The improvement of claim 9, further comprising a switch operable through one of said tone and volume control knobs to select predetermined tone and volume control information stored in said digital memory.

11. The improvement of claim 10, further comprising a status indicator responsive to operation of said switch.

12. The improvement of claim 8, further comprising means for controlling electrical energization of digital control of said analog circuit in response to use of the instrument.

13. The improvement of claim 12, wherein said means for controlling electrical energization includes means, connected to the pickup, for generating an energization control signal in response to movement of at least one of the strings of the instrument.

14. An electric stringed musical instrument, comprising:

a body;

strings connected to said body;

a pickup connected to said body such that said pickup generates an analog electric signal in response to movement of at least one of said strings;

a tone adjustment potentiometer connected to said body such that a player of the musical instrument can actuate said tone adjustment potentiometer;

a volume adjustment potentiometer connected to said body such that the player can actuate said volume adjustment potentiometer;

an output jack connected to said body;

an analog circuit connected to said pickup and said output jack, said analog circuit including a tone adjustment Portion having a resistance-capacitance characteristic and said analog circuit including a volume adjustment portion having a resistance characteristic; and a digital control circuit, connected to said body, said tone adjustment potentiometer, said volume adjustment potentiometer and said analog circuit, to digitally control the resistance-capacitance characteristic of said tone adjustment portion of said analog circuit and the resistance characteristic of said volume adjustment portion of said analog circuit in response to respective analog signals from said tone adjustment potentiometer and said volume adjustment potentiometer.

15. An electric stringed musical instrument as defined in claim 14, wherein said digital control circuit includes means for storing preset information with which to control said analog circuit, wherein the preset information is responsive to selected settings of said tone adjustment potentiometer and said volume adjustment potentiometer.

16. An electric stringed musical instrument as defined in claim 15, wherein at least one of said tone adjustment potentiometer and said volume adjustment potentiometer includes means for being rotated by the player, and further wherein said instrument also comprises a switch operatively connected to said means for being rotated, which said means is also adapted for being depressed by the player to operate said switch to provide a signal to said digital control circuit to select stored preset information for controlling said analog circuit.

17. An electric stringed musical instrument, comprising:

a body;

strings connected to said body;

a pickup connected to said body such that said pickup generates an electric signal in response to movement of at least one of said strings;

tone adjustment means connected to said body such that a player of the musical instrument can actuate said tone adjustment means;

volume adjustment means connected to said body such that the player can actuate said volume adjustment means;

an output jack connected to said body;

an analog circuit connected to said pickup and said output jack; and digital control means, connected to said body, said tone adjustment means, said volume adjustment means and said analog circuit, for controlling settings of said analog circuit; wherein:

said tone adjustment means includes:

a pan control knob mounted on said body;

a first potentiometer/switch combination connected to said pan control knob;

a treble control knob mounted on said body;

a second potentiometer/switch combination connected to said treble control knob;

a midrange control knob mounted on said body;

a third potentiometer/switch combination connected to said midrange control knob;

a bass control knob mounted on said body;

a fourth potentiometer/switch combination connected to said bass control knob; and an equalization on/off switch arm mounted on said body;

said volume adjustment means includes:

a volume control knob mounted on said body; and a fifth potentiometer/switch combination connected to said volume control knob;

said digital control means includes central processing means, connected to said potentiometer/switch combinations, for generating digital control signals in response to settings of said potentiometer/switch combinations; and said analog circuit includes digitally controlled potentiometers for variably defining pan, treble, midrange, bass and volume characteristics of said analog circuit in response to the digital control signals from said central processing means.

18. An electric stringed musical instrument as defined in claim 17, further comprising a plurality of light emitting indicators disposed on said body with said knobs.

19. An electric stringed musical instrument as defined in claim 17, wherein said digital control means further includes means, responsive to movement of at least one of said strings, for providing an energization control signal to said central processing means.

20. An electric stringed musical instrument, comprising:

a body;

strings connected to said body;

a pickup connected to said body such that said pickup generates an electric signal in response to movement of at least one of said strings;

tone adjustment means connected to said body such that a player of the musical instrument can actuate said tone adjustment means;

volume adjustment means connected to said body such that the player can actuate said volume adjustment means;

an output jack connected to said body;

an analog circuit connected to said pickup and said output jack; and digital control means, connected to said body, said tone adjustment means, said volume adjustment means and said analog circuit, for controlling settings of said analog circuit; wherein:

said tone adjustment means includes:

a tone control knob and a selector switch operating member mounted on said body;

a multiple position switch connected to said selector switch operating member; and a first potentiometer/switch combination connected to said tone control knob;

said volume adjustment means includes:

a volume control knob mounted on said body; and a second potentiometer/switch combination connected to said volume control knob;

said digital control means includes central processing means, connected to said multiple position switch and said potentiometer/switch combinations, for generating digital control signals in response to settings of said multiple position switch and said potentiometer/switch combinations; and said analog circuit includes digitally controlled potentiometers for variably defining tone and volume characteristics of said analog circuit in response to the digital control signals from said central processing means.

21. An electric stringed musical instrument as defined in claim 20, further comprising a plurality of light emitting indicators disposed on said body with said knobs.

22. An electric stringed musical instrument as defined in claim 20, wherein said digital control means further includes means, responsive to movement of at least one of said strings, for providing an energization control signal to said central processing means.

23. An electric stringed musical instrument, comprising:

a body;

strings connected to said body;

a pickup connected to said body such that said pickup generates an electric signal in response to movement of at least one of said strings;

an output jack connected to said body; and an electrical circuit connected to said pickup and said output jack to provide an output signal to said output jack in response to the electric signal from said pickup, said electrical circuit including means for generating a circuit energization control signal to switch at least a portion of said electrical circuit from a non-operational powered down mode to an operational powered up mode in response to movement of at least one of said strings.

24. An electric stringed musical instrument as defined in claim 23, wherein said means for generating a circuit energization control signal is connected to said pickup.

25. An electric stringed musical instrument as defined in claim 24, wherein said electrical circuit further includes:

a first circuit portion including said means for generating a circuit energization control signal, said first circuit portion further including a first voltage conversion and regulator device, a second voltage conversion and regulator device, and a microcontroller connected to said means for generating a circuit energization control signal and to said first and second voltage conversion and regulator devices; and a second circuit portion connected to receive electrical energization from said second voltage conversion and regulator device controlled by said microcontroller in response to the circuit energization control signal of said means for generating provided to said microcontroller.

26. An electric stringed musical instrument as defined in claim 25, wherein said instrument further comprises a battery mounted on said body, said battery having a terminal connected to said first and second voltage conversion and regulator devices.

27. An electric stringed musical instrument as defined in claim 26, wherein said battery has another terminal, said another terminal connected to said jack such that said another terminal is connected to an electrical ground in response to plugging a plug into said jack.

28. Electric stringed musical instrument apparatus, comprising:

a manually operable analog tone-control member adapted to mount on an electric stringed musical instrument;

an analog circuit adapted to mount on the electric stringed musical instrument to process, within the analog domain, an analog electric signal generated by the electric stringed musical instrument; and a digital control circuit adapted to connect to said tone-control member and said analog circuit on the electric stringed musical instrument such that said digital control circuit digitally controls a tone characteristic of said analog circuit in response to an analog signal from said tone-control member.

29. Apparatus as defined in claim 28, wherein:

said digital control circuit includes a memory in which to store preset tone control information defined in response to an analog signal from said tone-control member; and said apparatus further comprises a manually operable switch connected to said digital control circuit such that actuation of said switch causes said digital control circuit to control said analog circuit in response to the stored preset tone control information.

30. Apparatus as defined in claim 28, wherein:

said tone-control member includes a potentiometer that a player of the musical instrument operates on the musical instrument;

said analog circuit includes a tone adjustment portion having a resistance-capacitance characteristic; and said digital control circuit connects to said potentiometer and digitally controls said resistance-capacitance characteristic in response to analog signals from said potentiometer.

31. Apparatus as defined in claim 30, wherein:

said digital control circuit includes a memory in which to store preset tone control information defined in response to an analog signal from said potentiometer; and said apparatus further comprises a manually operable switch connected to said digital control circuit such that actuation of said switch causes said digital control circuit to control said analog circuit in response to the stored preset tone control information.

32. Apparatus as defined in claim 31, wherein said potentiometer includes means for being rotated by the player and further wherein said manually operable switch is operatively connected to said means for being rotated, which said means is also adapted for being depressed by the player to operate said switch to provide a signal to said digital control circuit to select stored preset tone-control information for controlling said analog circuit.

* * * * *

UNITED STATES PATENT AND TRADEMARK OFFICE

CERTIFICATE OF CORRECTION

Patent No.: 5,866,834

Dated: February 2, 1999

Inventors: Jim Burke and William K. Flint

It is certified that errors appear in the above-identified patent and that said Letters Patent is hereby corrected as shown below:

Column 58, line 32, change "Portion" to --portion--.

Column 58, line 36, delete the subparagraph break after "potentiometer,".

Signed and Sealed this

Twenty-fifth Day of April, 2000

*Attest:*

Q. TODD DICKINSON

*Attesting Officer*

*Director of Patents and Trademarks*